US010640921B2

(12) United States Patent
Mabuchi

(10) Patent No.: US 10,640,921 B2
(45) Date of Patent: May 5, 2020

(54) TWISTED WIRE MANUFACTURING METHOD

(71) Applicant: YAZAKI CORPORATION, Tokyo (JP)

(72) Inventor: Miyoshi Mabuchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 181 days.

(21) Appl. No.: 15/608,205

(22) Filed: May 30, 2017

(65) Prior Publication Data

US 2017/0350071 A1 Dec. 7, 2017

(30) Foreign Application Priority Data

Jun. 6, 2016 (JP) ..... 2016-112395

(51) Int. Cl.

| | |
|---|---|
| ***D07B 3/00*** | (2006.01) |
| ***D07B 3/12*** | (2006.01) |
| ***B21F 7/00*** | (2006.01) |
| ***B21F 15/04*** | (2006.01) |
| ***D07B 3/04*** | (2006.01) |

(Continued)

(52) U.S. Cl.

CPC ..... *D07B 3/005* (2013.01); *B21F 7/00* (2013.01); *B21F 15/04* (2013.01); *D07B 3/045* (2013.01); *D07B 3/12* (2013.01); *D07B 7/10* (2013.01); *D01H 1/00* (2013.01); *D02G 3/28* (2013.01); *D02G 3/286* (2013.01); *D02G 3/32* (2013.01);

(Continued)

(58) Field of Classification Search

CPC ..... D07B 3/005; D07B 3/045; D07B 3/12; D07B 3/28; D07B 2867/10; D07B 2501/406; B21F 7/00; B21F 15/04; H01B 13/02; D02G 3/28; D02G 3/32; D01H 1/00

USPC ..... 57/293

See application file for complete search history.

(56) References Cited

U.S. PATENT DOCUMENTS 605,930 A * 6/1898 Stauffer ..... B21F 3/04 140/90
800,774 A * 10/1905 Turner ..... D07B 3/14 57/27

(Continued)

FOREIGN PATENT DOCUMENTS

CN 101546628 A 9/2009
CN 101552134 A 10/2009

(Continued)

OTHER PUBLICATIONS

Chinese Office Action for the related Chinese Patent Application No. 201710419291.1 dated Jan. 11, 2019.

*Primary Examiner* — Alissa J Tompkins
*Assistant Examiner* — Dakota Marin
(74) *Attorney, Agent, or Firm* — Kenealy Vaidya LLP

(57) ABSTRACT

A twisted wire manufacturing method for manufacturing a twisted wire, includes hanging U-turn portions of the at least two wires on a wire hanging member, checking one end portions and the other end portions of the at least two wires, pulling up the at least two wires in a state that the U-turn portions are hung on the wire hanging member, twisting the at least two wires together after the wire pull-up step is conducted, and transferring a twist-completed wire produced by the wire twisting step to a twisted wire temporary placement hook which is disposed above the wire hanging member.

5 Claims, 27 Drawing Sheets

(51) Int. Cl.

| | |
|---|---|
| ***D07B 7/10*** | (2006.01) |
| *H01B 13/02* | (2006.01) |
| *D01H 1/00* | (2006.01) |
| *D02G 3/28* | (2006.01) |
| *D02G 3/32* | (2006.01) |

(52) U.S. Cl.
CPC ..... *D07B 2501/406* (2013.01); *H01B 13/02* (2013.01)

(56) References Cited

U.S. PATENT DOCUMENTS 1,252,404 A * 1/1918 Crane ..... D01H 9/04 57/274
1,442,263 A * 1/1923 Fullington ..... D07B 3/12 57/27
1,447,538 A * 3/1923 Fullington ..... D07B 3/12 242/396.9
1,660,664 A * 2/1928 Aleksandrowicz .. A43C 11/004 36/50.1
3,307,340 A * 3/1967 Masahiko ..... D01H 9/10 57/269
3,631,733 A * 1/1972 Thompson, Jr. ..... F16G 9/00 474/255
4,112,662 A * 9/1978 Lappage ..... B65H 54/02 242/472.2
4,452,160 A * 6/1984 Tajiri ..... D02G 1/0266 112/410
5,119,621 A * 6/1992 Inger ..... B65H 54/26 57/281
5,222,350 A * 6/1993 Bowman ..... B65H 67/069 57/267
5,517,813 A * 5/1996 Klundt ..... B21F 15/04 140/49
5,535,581 A * 7/1996 Tahara ..... D01H 9/008 19/159 A
5,913,469 A 6/1999 Suzuki
5,960,581 A * 10/1999 Schneider ..... A01K 91/16 140/119
6,324,872 B1 * 12/2001 Blaszyk ..... C03B 37/03 65/504
2009/0241314 A1 * 10/2009 Watanabe ..... H01B 13/0271 29/33 F
2012/0227857 A1 9/2012 Watanabe
2013/0048141 A1 2/2013 Conte et al.

FOREIGN PATENT DOCUMENTS

CN 102969642 A 3/2013
CN 104217823 A 12/2014
JP 2003-217371 A 7/2003
JP 2008-277032 A 11/2008

* cited by examiner

TWISTED WIRE MANUFACTURING METHOD

CROSS REFERENCE TO RELATED APPLICATIONS

This application is based on Japanese Patent Application (No. 2016-112395) filed on Jun. 6, 2016, the contents of which are incorporated herein by reference.

BACKGROUND OF THE INVENTION

1. Field of the Invention

The present invention relates to a twisted wire manufacturing method for manufacturing a twisted wire by twisting at least two wires together.

2. Description of the Related Art

For example, wire harnesses are routed in a vehicle to electrically connect devices installed in the vehicle. Each wire harness has plural subharnesses. A wire harness having such a structure is manufactured by combining subharnesses so as to be suitable for a desired circuit pattern. One example of the subharness is a twisted pair wire (twisted wire).

As shown in FIGS. 27A and 27B, a twisted wire 102 is manufactured by twisting two wires 101 together. For example, JP-A-2008-277032 (see below) discloses a related apparatus for manufacturing such a twisted wire 102. The twisted wire manufacturing apparatus (wires twisting apparatus) disclosed in JP-A-2008-277032 includes a working stage, a holding unit for holding one end portions of two wires on the working stage, a motor for rotating the holding unit about the apparatus axis, a rotary holding unit in which a pair of single wire holding units are arranged side by side each of which holds the other end portion of a single wire in such a manner that the wire is rotatable about its axis, a movable holding unit which is disposed so as to be movable along the apparatus axis, a drive unit for moving the movable holding unit along the apparatus axis, and a control unit for controlling the movement speed etc. of the movable holding unit.

The above related technique has a problem that since the twisted wire 102 is manufactured in a long, straight form, to manufacture the twisted wire 102 it is necessary to secure a long apparatus installation space that is longer than or equal to the wires 101 in the horizontal direction. Another problem that to remove a manufactured twisted wire 102 a worker needs to bother to walk to the position where the far end of the twisted wire 102 is located, which means low work efficiency.

Furthermore, in the above related technique, the worker needs to carry each twisted wire 102 removed from the working stage to a temporary storage place and, when a prescribed number of twisted wires 102 have been stored, bundle them and move them to a final storage space. This not only lowers the work efficiency but also necessitates securing of an additional space.

SUMMARY OF THE INVENTION

The present invention has been made in view of the above circumstances, and an object of the invention is therefore to provide a twisted wire manufacturing method capable of reducing the installation space etc. and increasing the work efficiency.

There is provided a twisted wire manufacturing method for manufacturing a twisted wire by twisting at least two wires together, the method including:

a wire middle portion hanging step of hanging U-turn portions of the at least two wires on a wire hanging member, the U-turn portions being positioned at middle of the at least two wires;

a wire end portions chucking step of checking one end portions and the other end portions of the at least two wires;

a wire pull-up step of pulling up the at least two wires in a state that the U-turn portions are hung on the wire hanging member;

a wire twisting step of twisting the at least two wires together after the wire pull-up step is conducted; and a twisted wire discharging step of transferring a twist-completed wire produced by the wire twisting step to a twisted wire temporary placement hook which is disposed above the wire hanging member.

BRIEF DESCRIPTION OF THE DRAWINGS

FIG. 6A shows a first-half wire housing unit and a second-half wire housing unit of the upper-stage, FIG. 6B shows a first-half wire housing unit and a second-half wire housing unit of the lower-stage, and FIG. 6C shows end portions of the first-half wire housing units and the second-half wire housing units.

FIG. 9A shows a proper state and FIG. 9B shows an improper state that the wires cross each other.

FIG. 14A shows a state before chucking and FIG. 14B shows a state after chucking.

FIG. 18 is viewed from a direction indicated by arrow E.

FIG. 27A shows two straight wires arranged side by side and FIG. 27B shows a twisted wire manufactured.

DETAILED DESCRIPTION OF THE EXEMPLARY EMBODIMENTS

The present invention provides a twisted wire manufacturing apparatus for manufacturing a twisted wire by twisting at least two wires together which includes a wire pull-up unit, a wire twisting unit, and a twisted wire discharging unit. The wire pull-up unit includes a wire hanging member on which middle, U-turn portions of the at least two wires are hung and which pulls up the at least two wires. The twisted wire discharging unit includes twisted wire temporary placement hooks disposed above the wire hanging member and a twisted wire transfer mechanism which transfers a twist-completed wire from the wire pull-up unit to the twisted wire temporary placement hooks.

Embodiment

Figure 1:
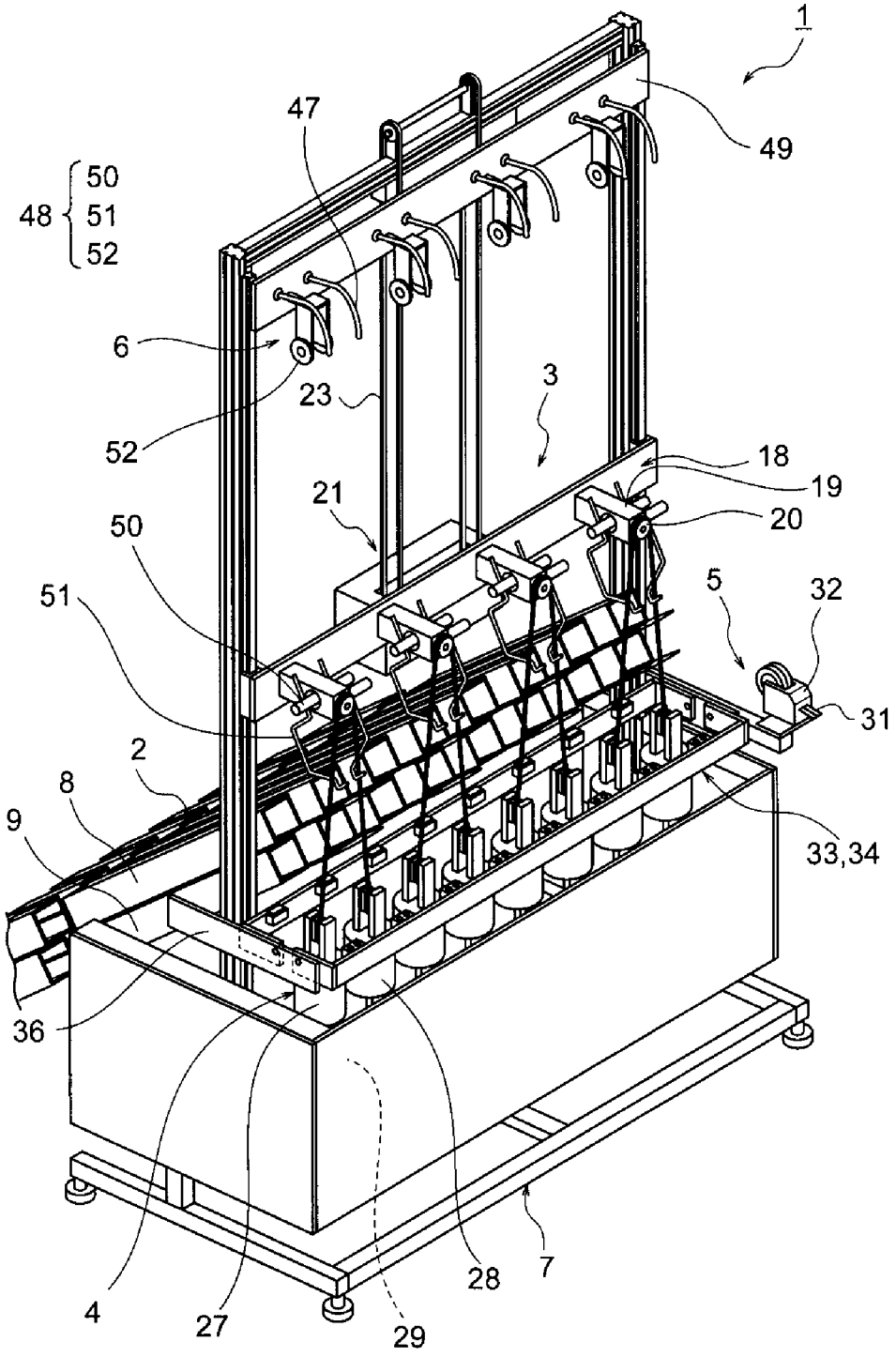
FIG. 1 outlines the configuration of a twisted wire manufacturing apparatus according to an embodiment of the present invention.
Figure 2:
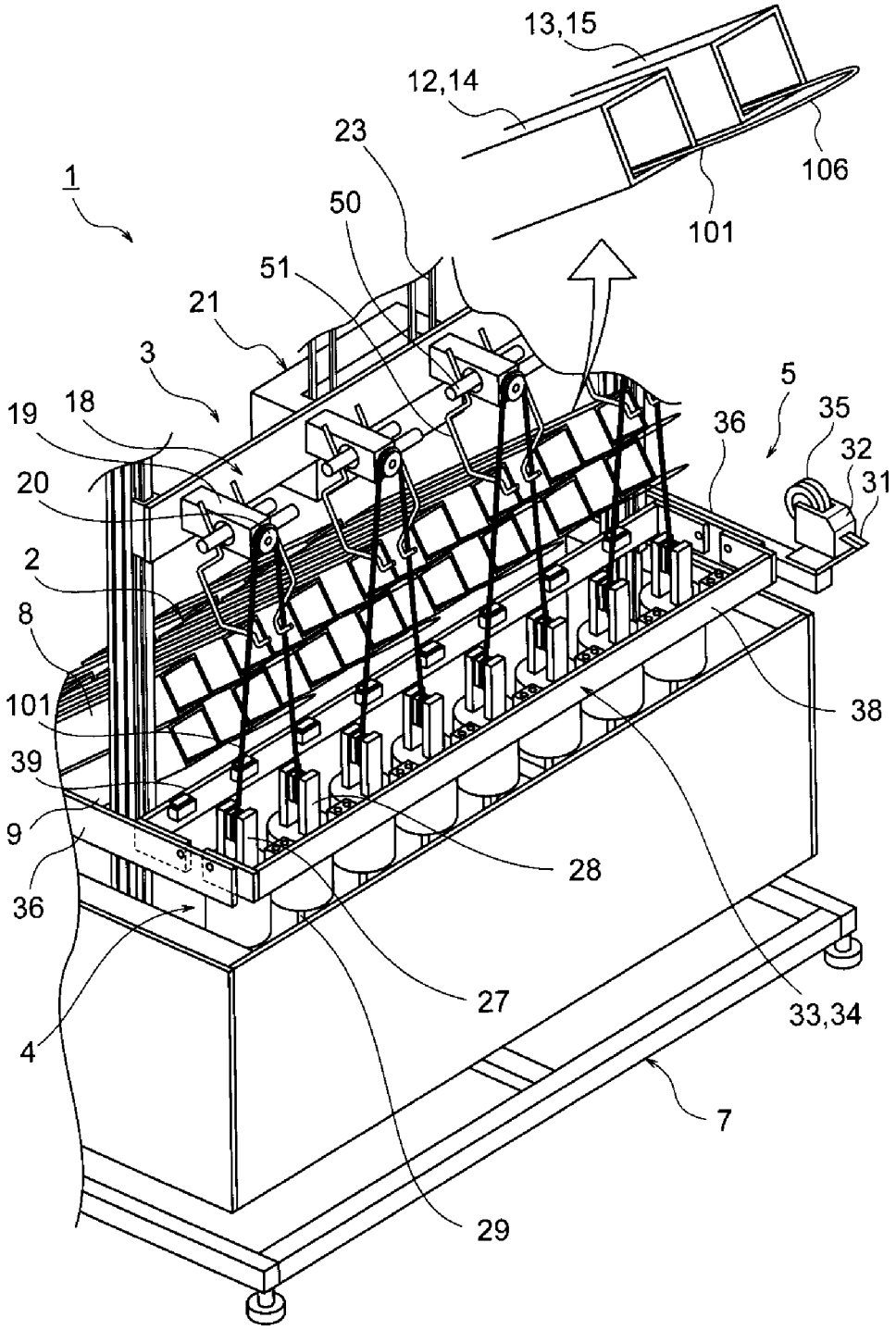
FIG. 2 is an enlarged view of a lower part of the twisted wire manufacturing apparatus shown in FIG. 1.
Figure 3:
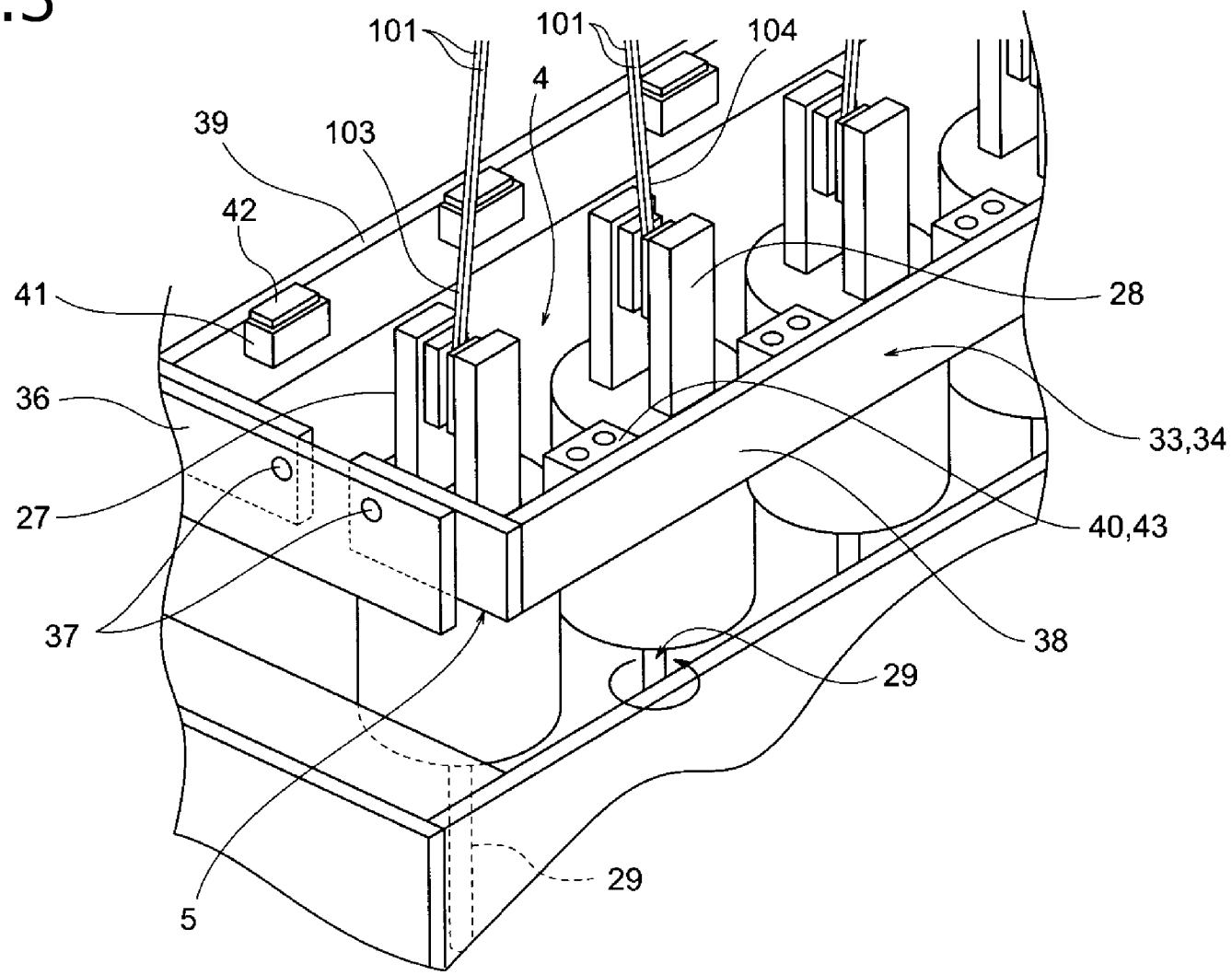
FIG. 3 is an enlarged view of a wire twisting unit and its neighborhood shown in FIG. 2.
Figure 4:
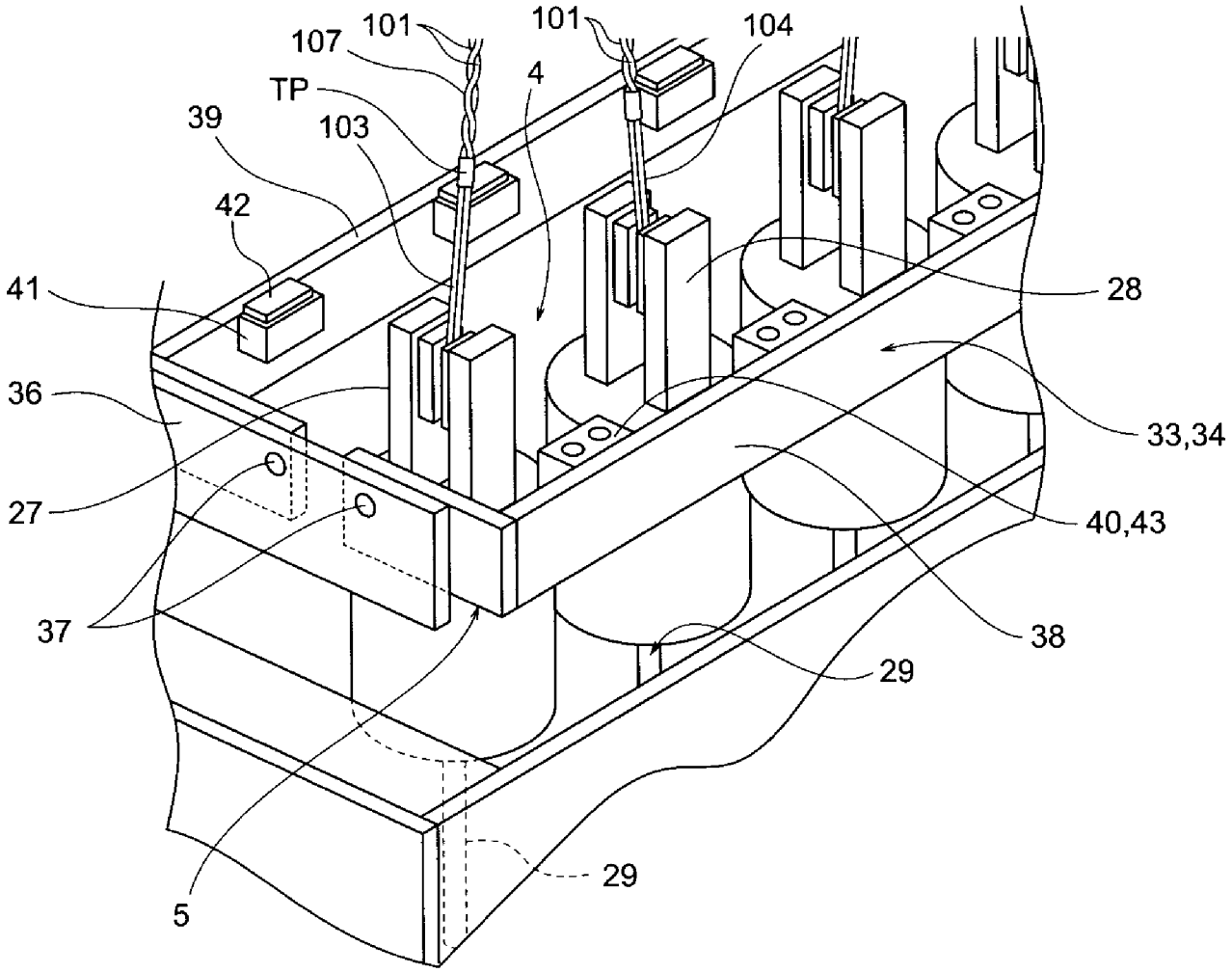
FIG. 4 is an enlarged view of the wire twisting unit 4 and its neighborhood in a state that wires have been twisted together.
Figure 5:
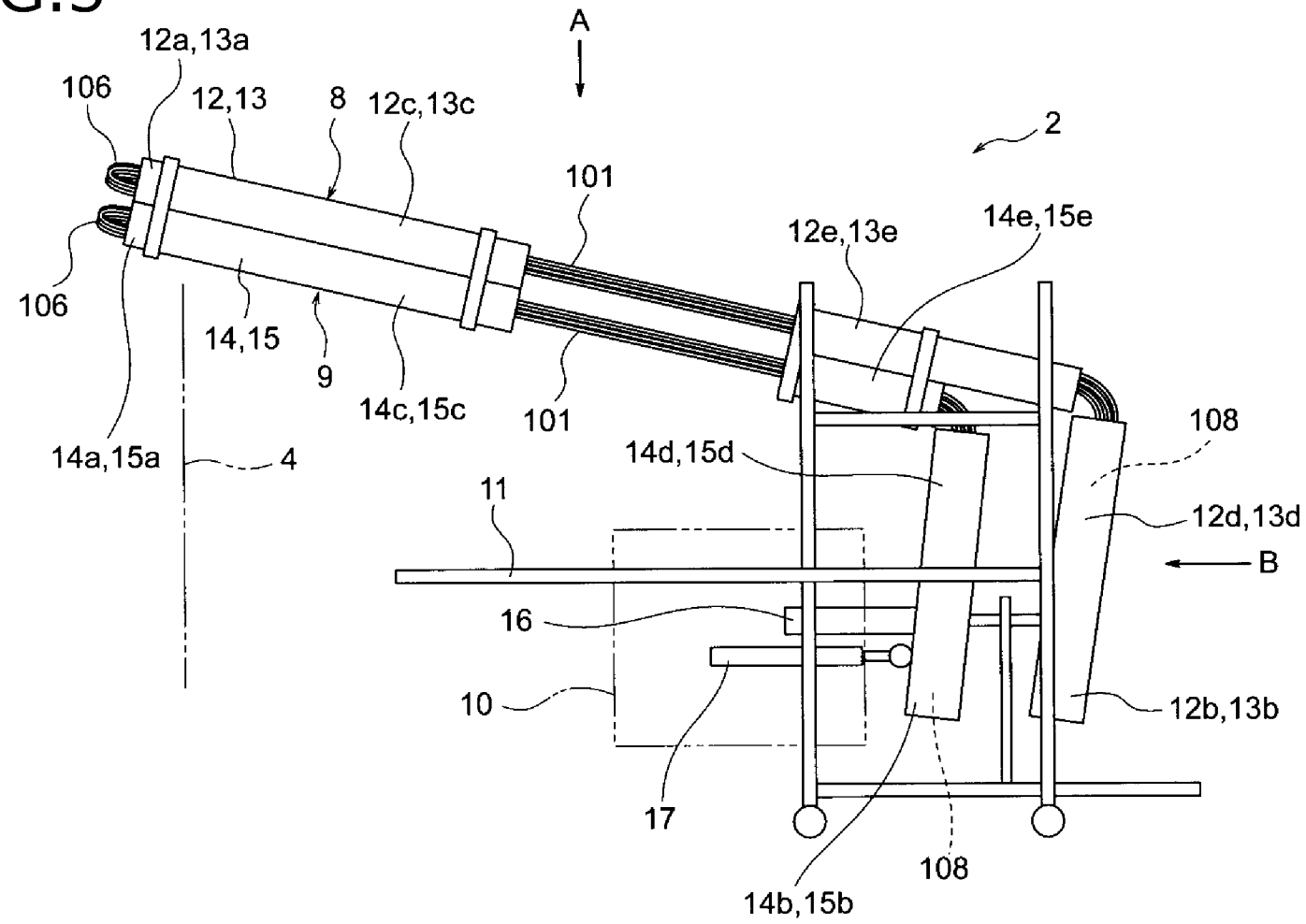
FIG. 5 outlines the configuration of a wire pull-out unit shown in FIG. 1.
Figure 6A:
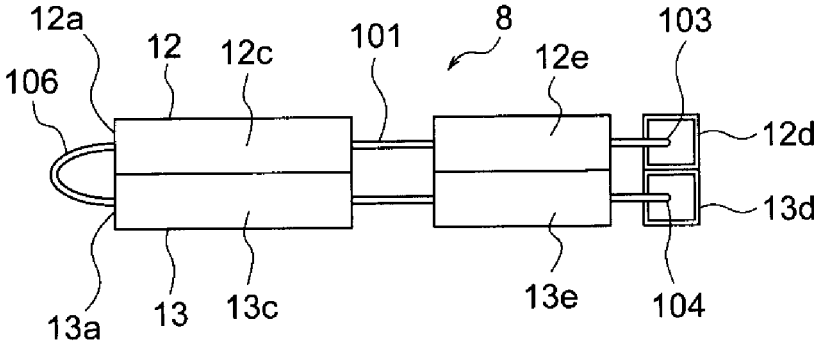
FIGS. 6A and 6B are views as viewed from a direction indicated by arrow A in FIG. 5.
Figure 6B:
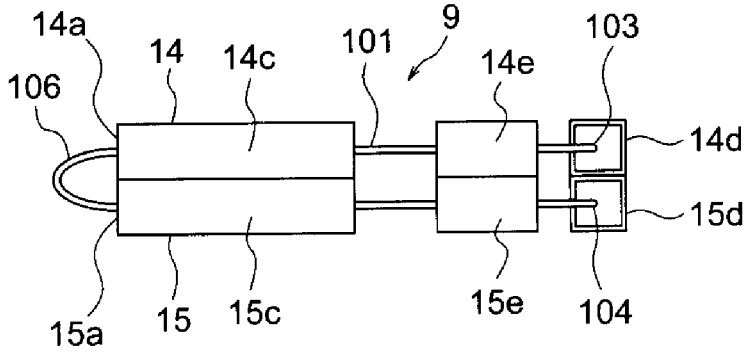
Figure 6C:
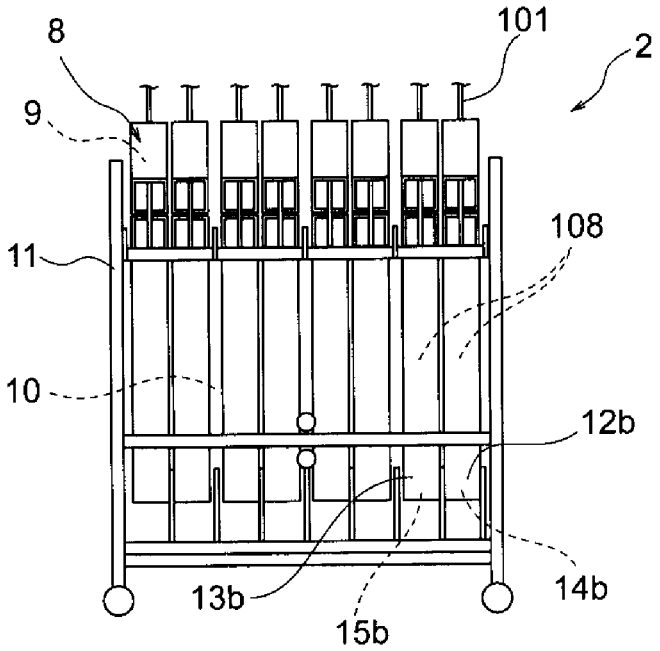
FIG. 6C is a view as viewed from a direction indicated by arrow B in FIG. 5; in detailed.

An embodiment of the invention will be hereinafter described with reference to the drawings. FIG. 1 outlines the configuration of a twisted wire manufacturing apparatus 1 according to the embodiment. FIG. 2 is an enlarged view of a lower part of the twisted wire manufacturing apparatus 1 shown in FIG. 1. FIG. 3 is an enlarged view of a wire twisting unit 4 and its neighborhood shown in FIG. 2. FIG. 4 is an enlarged view of the wire twisting unit 4 and its neighborhood in a state that wires have been twisted together. FIG. 5 outlines the configuration of a wire pull-out unit 2 shown in FIG. 1. FIGS. 6A and 6B are views as viewed from a direction indicated by arrow A in FIG. 5 and FIG. 6C is a view as viewed from a direction indicated by arrow B in FIG. 5.

Figure 7A:
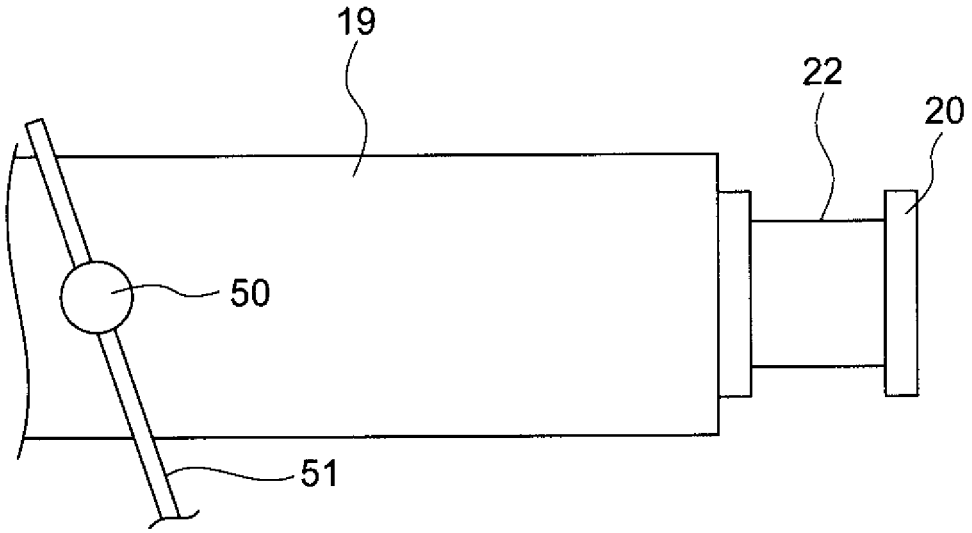
FIGS. 7A and 7B are a side view and a front view showing each wire pull-up mechanism of a wire pull-up unit.
Figure 7B:
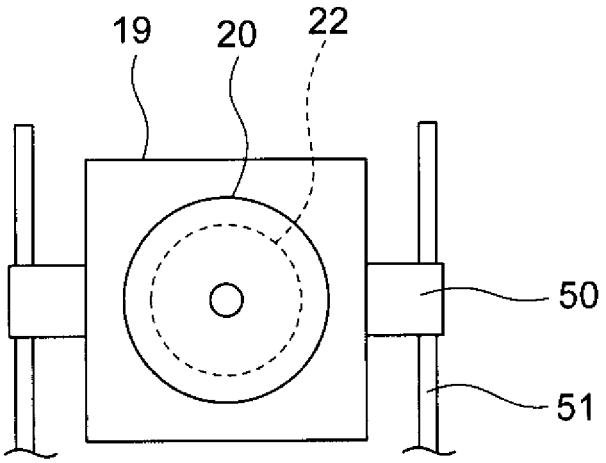
Figure 8A:
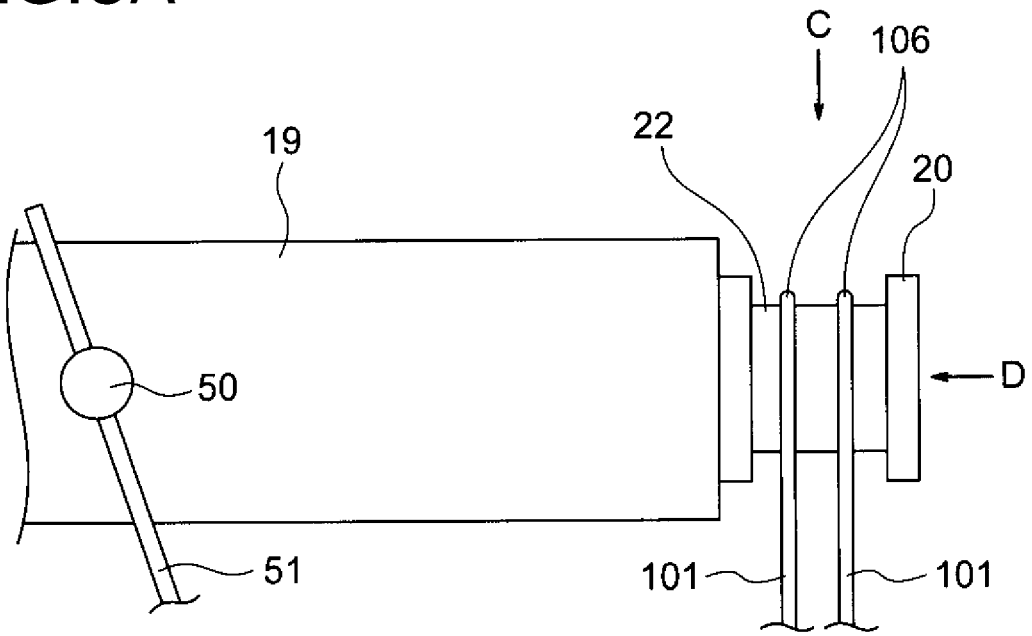
FIGS. 8A and 8B are a side view and a front view showing a state that middle portions of two wires are hung on the wire pull-up mechanism.
Figure 8B:
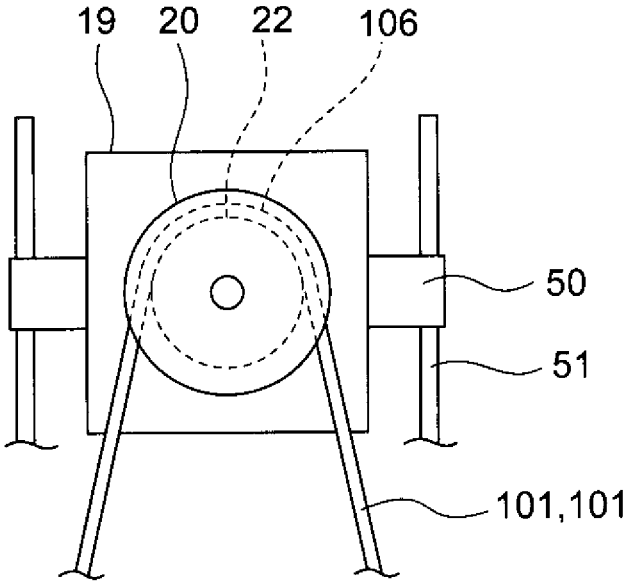
Figure 9B:
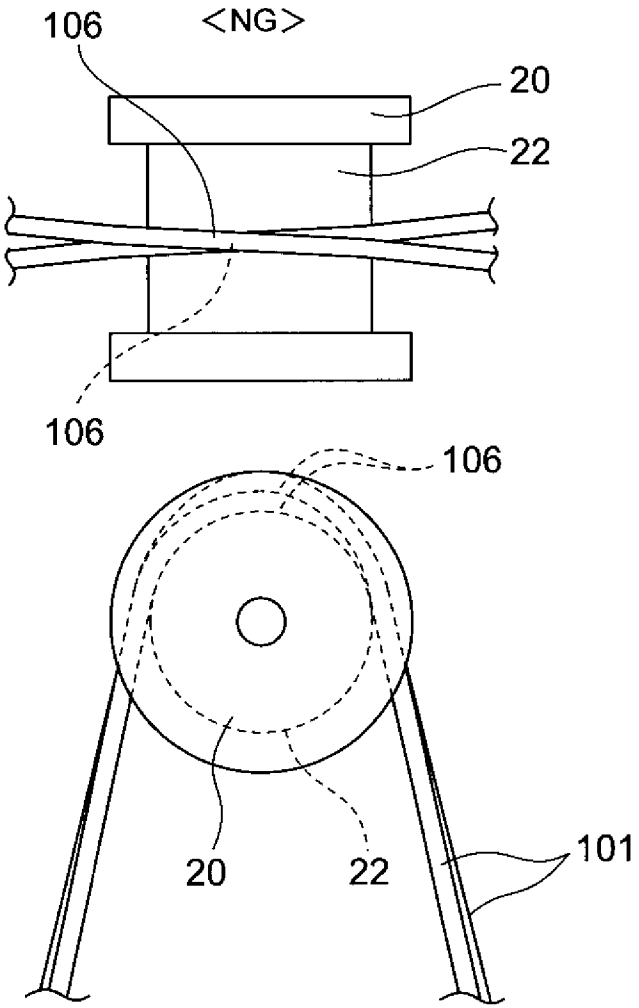
FIGS. 9A and 9B are views as viewed from directions indicated by arrows C and D in FIG. 8, respectively; in detailed.
Figure 9A:
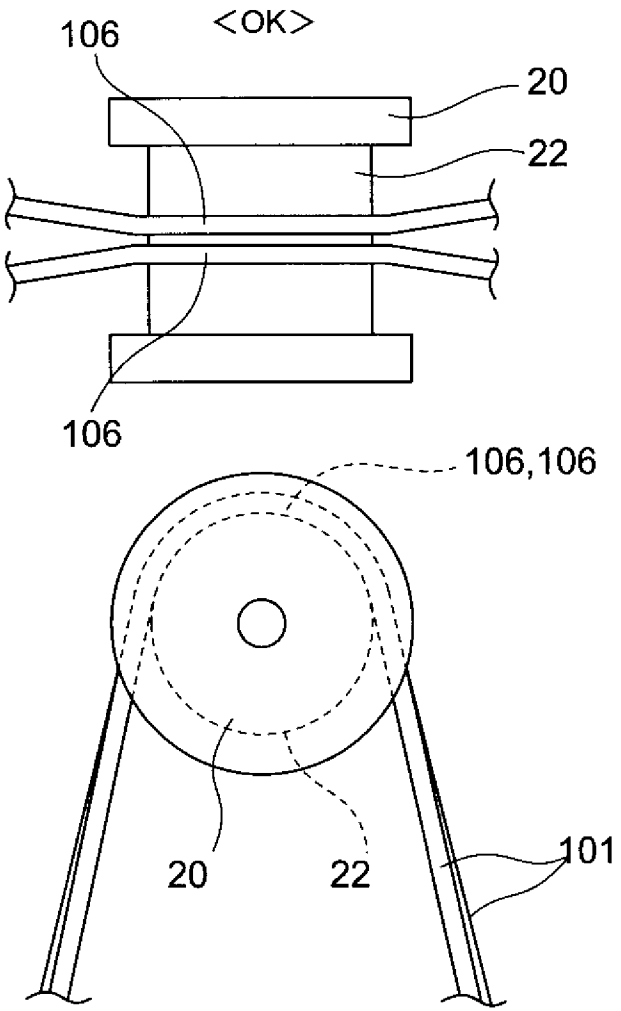
Figure 10:
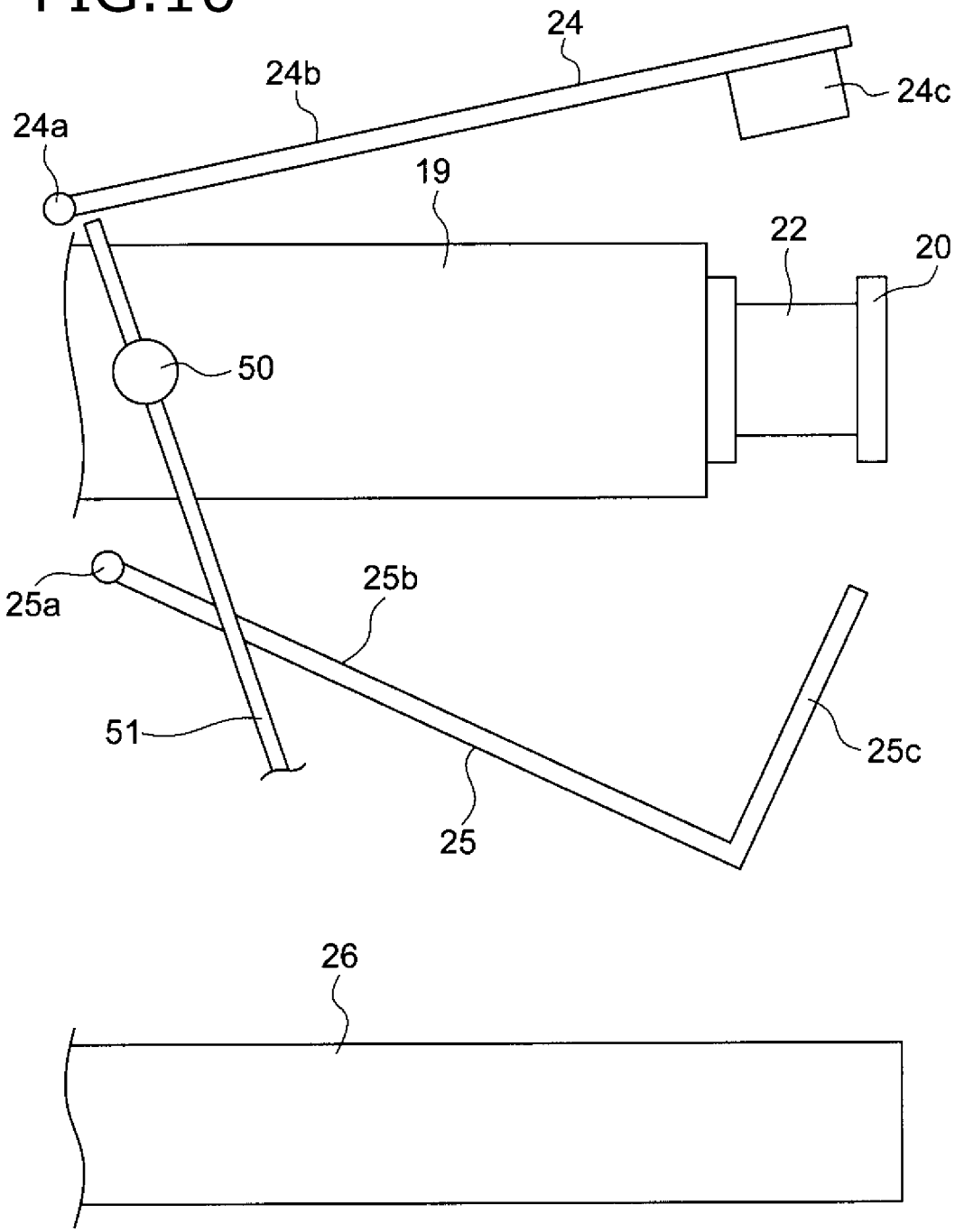
FIG. 10 is a side view showing a modification of the wire pull-up mechanism shown in FIGS. 7A and 7B.
Figure 11:
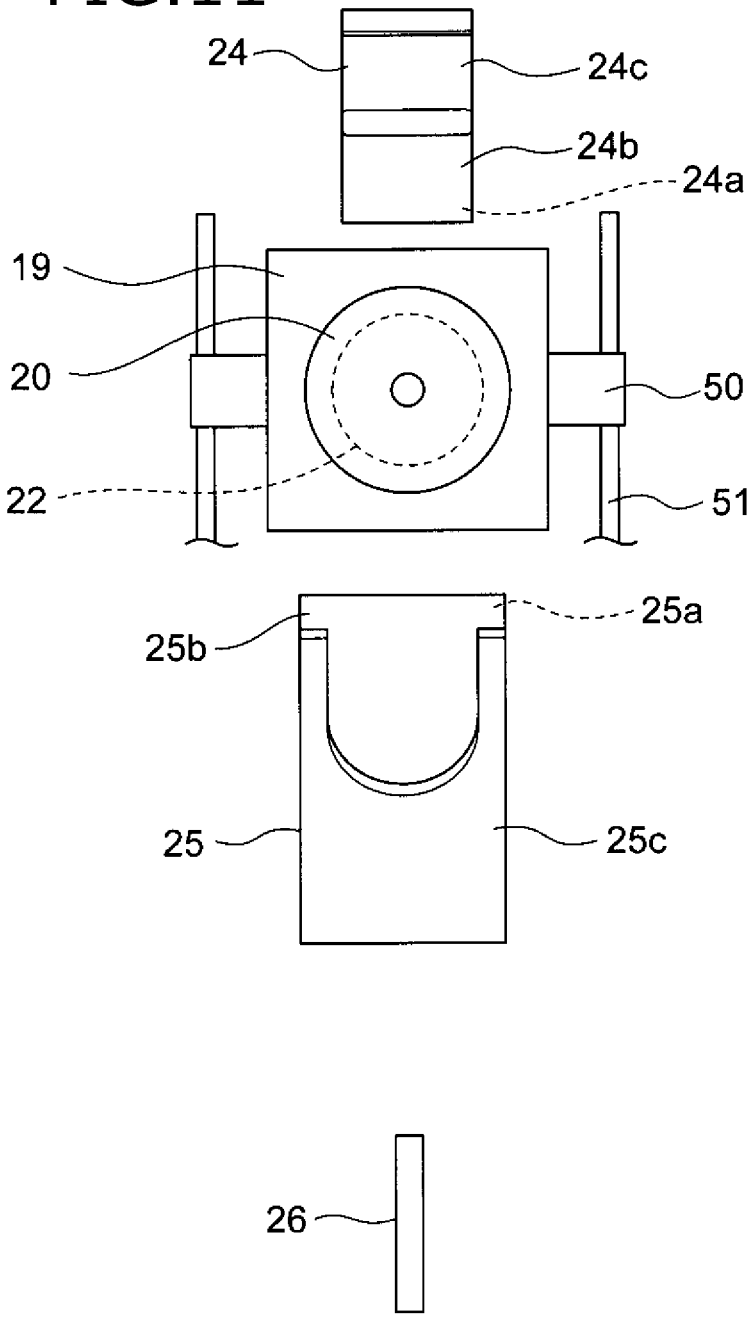
FIG. 11 is a front view of the modified wire pull-up mechanism shown in FIG. 10.
Figure 12:
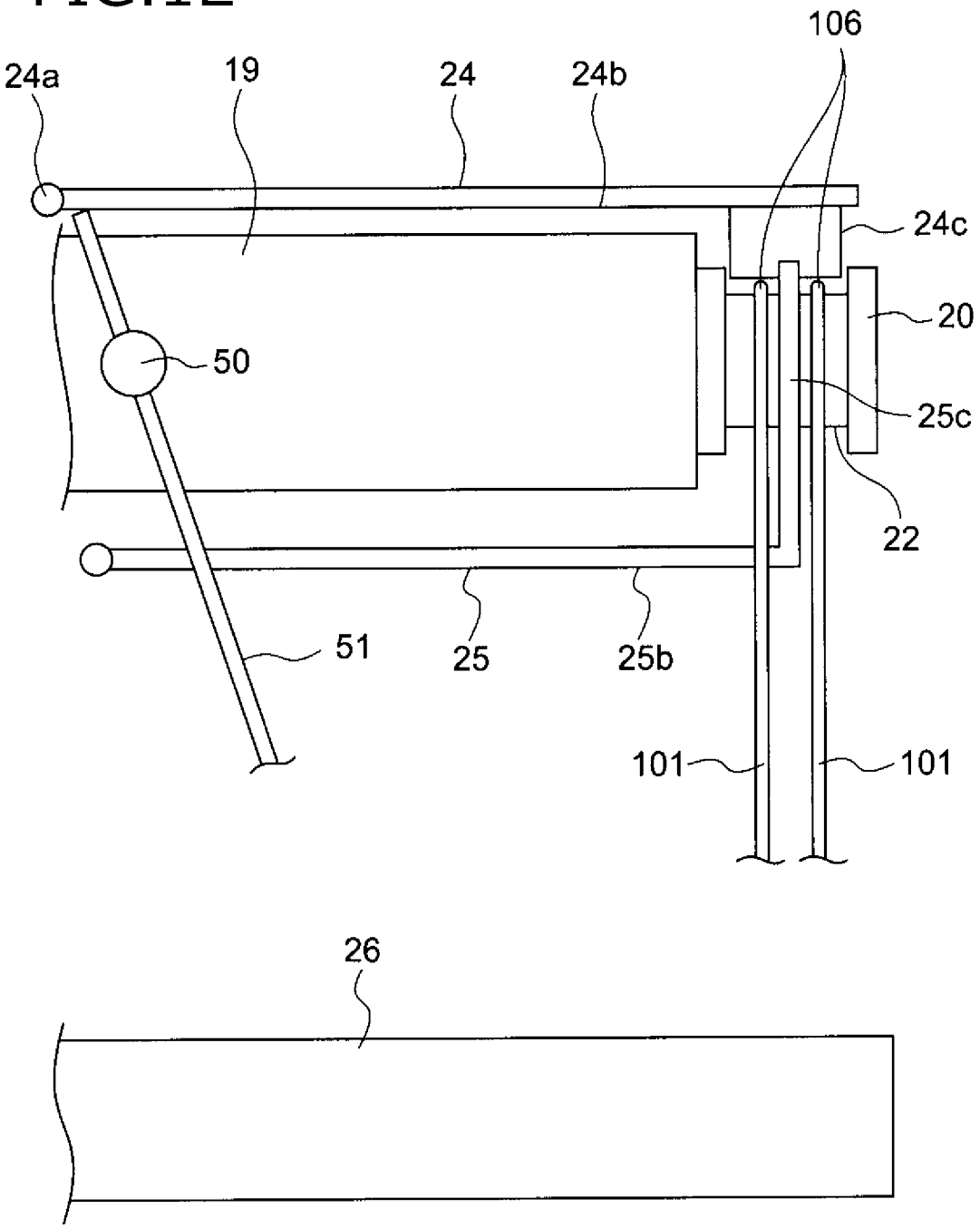
FIG. 12 is a side view showing a state that wire middle portions are hung on a wire hanging member that is attached to the body of the modified wire pull-up mechanism.
Figure 13:
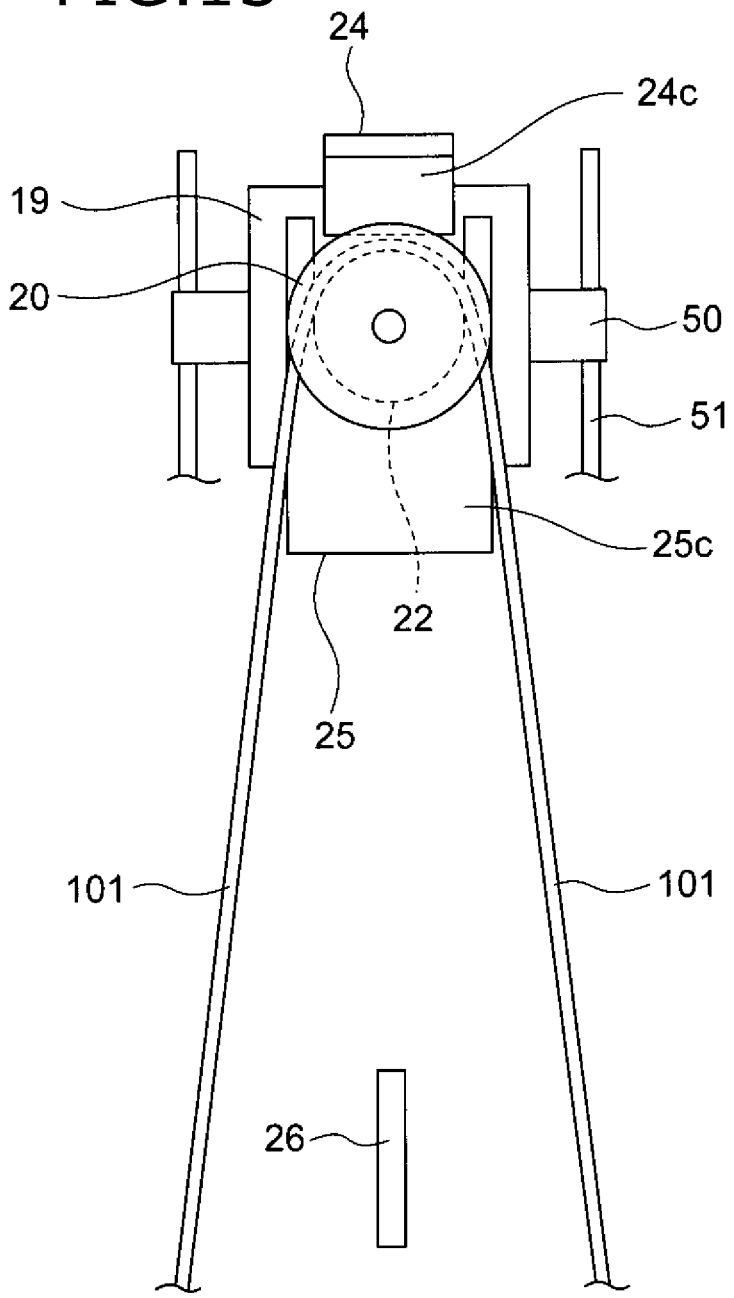
FIG. 13 is a front view corresponding to FIG. 12.
Figure 14B:
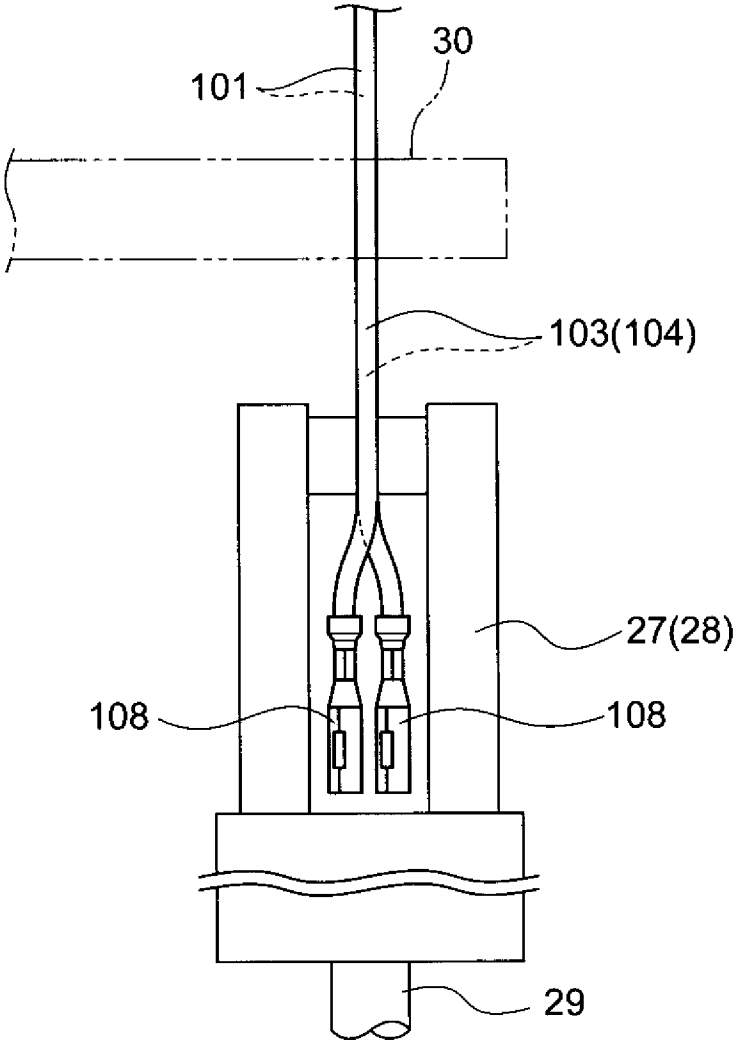
FIGS. 14A and 14B show a first-end chucking member, a second-end chucking member, and a wire ends separating plate; in detailed.
Figure 14A:
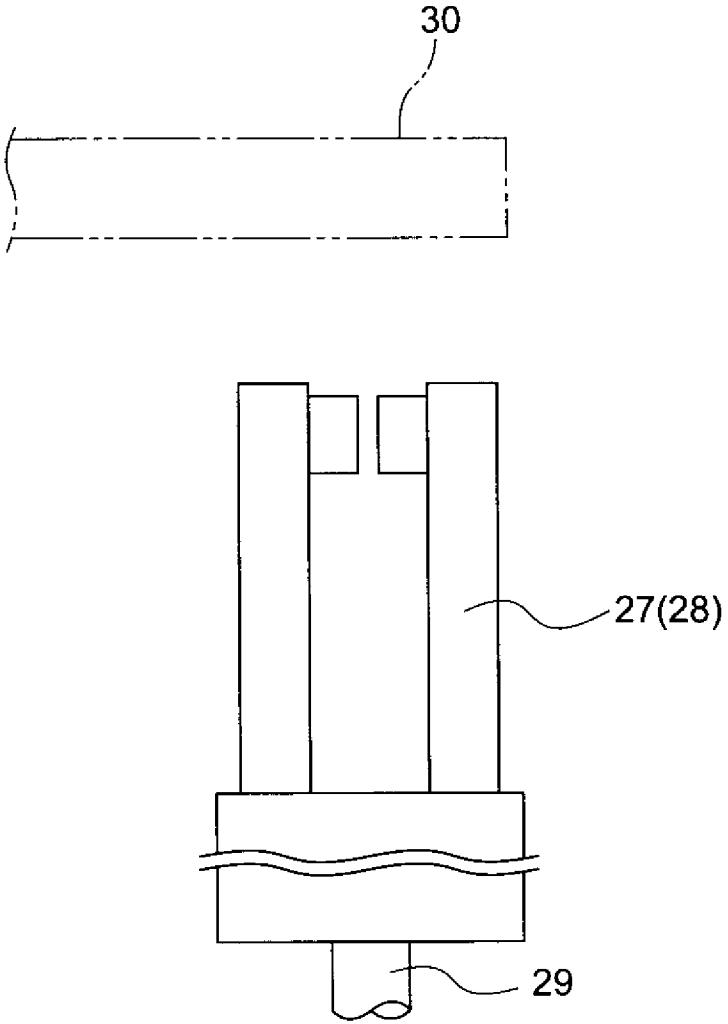

FIGS. 7A and 7B show each wire pull-up mechanism 19 of a wire pull-up unit 3. FIGS. 8A and 8B show a state that middle portions of two wires are hung on the wire pull-up mechanism 19. Each of FIGS. 9A and 9B is views as viewed from directions indicated by arrows C and D in FIG. 8, respectively. FIGS. 10-13 show a modification of the wire pull-up mechanism 19. FIGS. 14A and 14B show a first-end chucking member, a second-end chucking member, and a wire ends separating plate.

Figure 23:
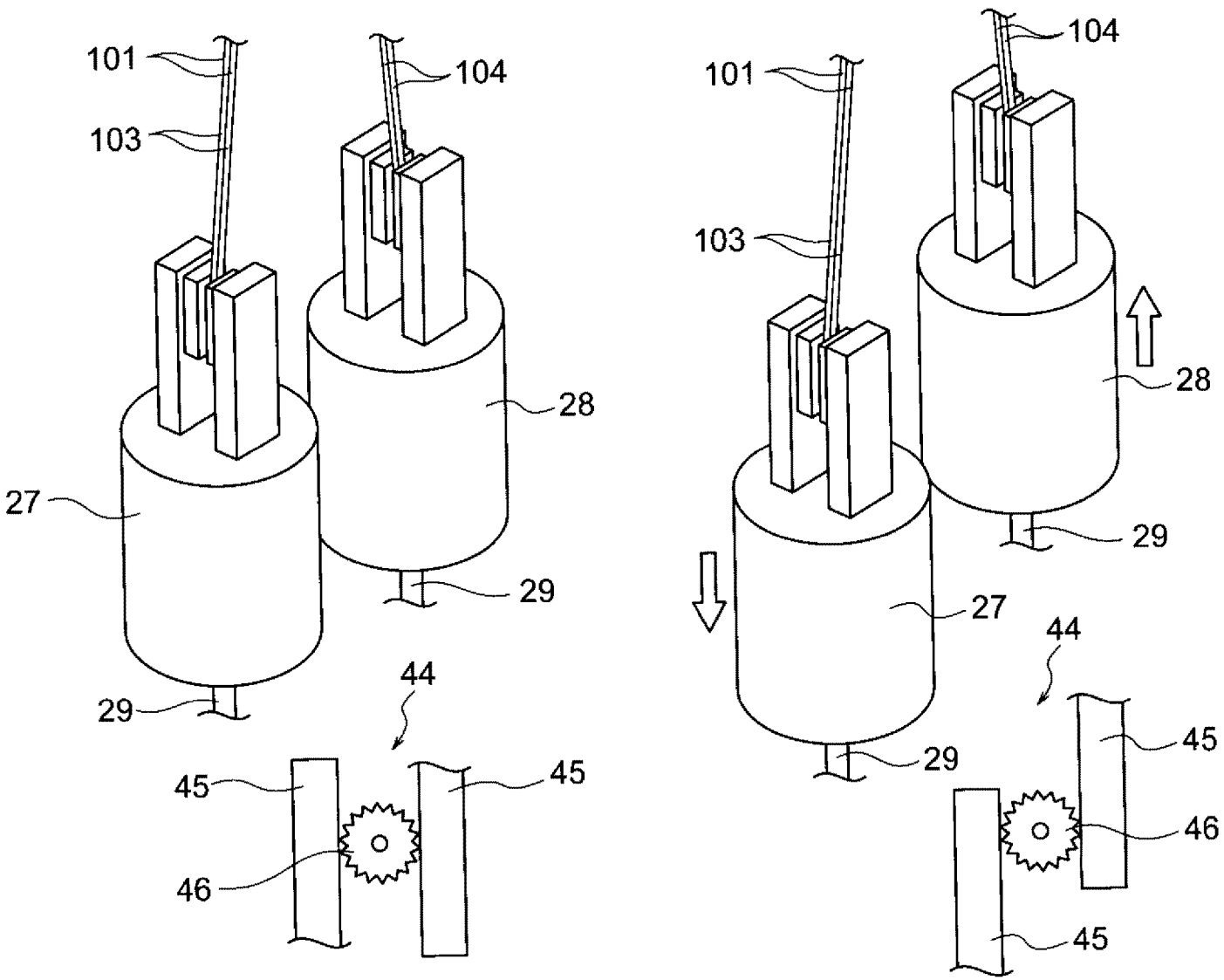
FIG. 23 is a schematic drawing showing a chuck vertical position changing unit that is used in the wire twisting step illustrated by FIGS. 21A-21C and 22A-22C.
Figure 24:
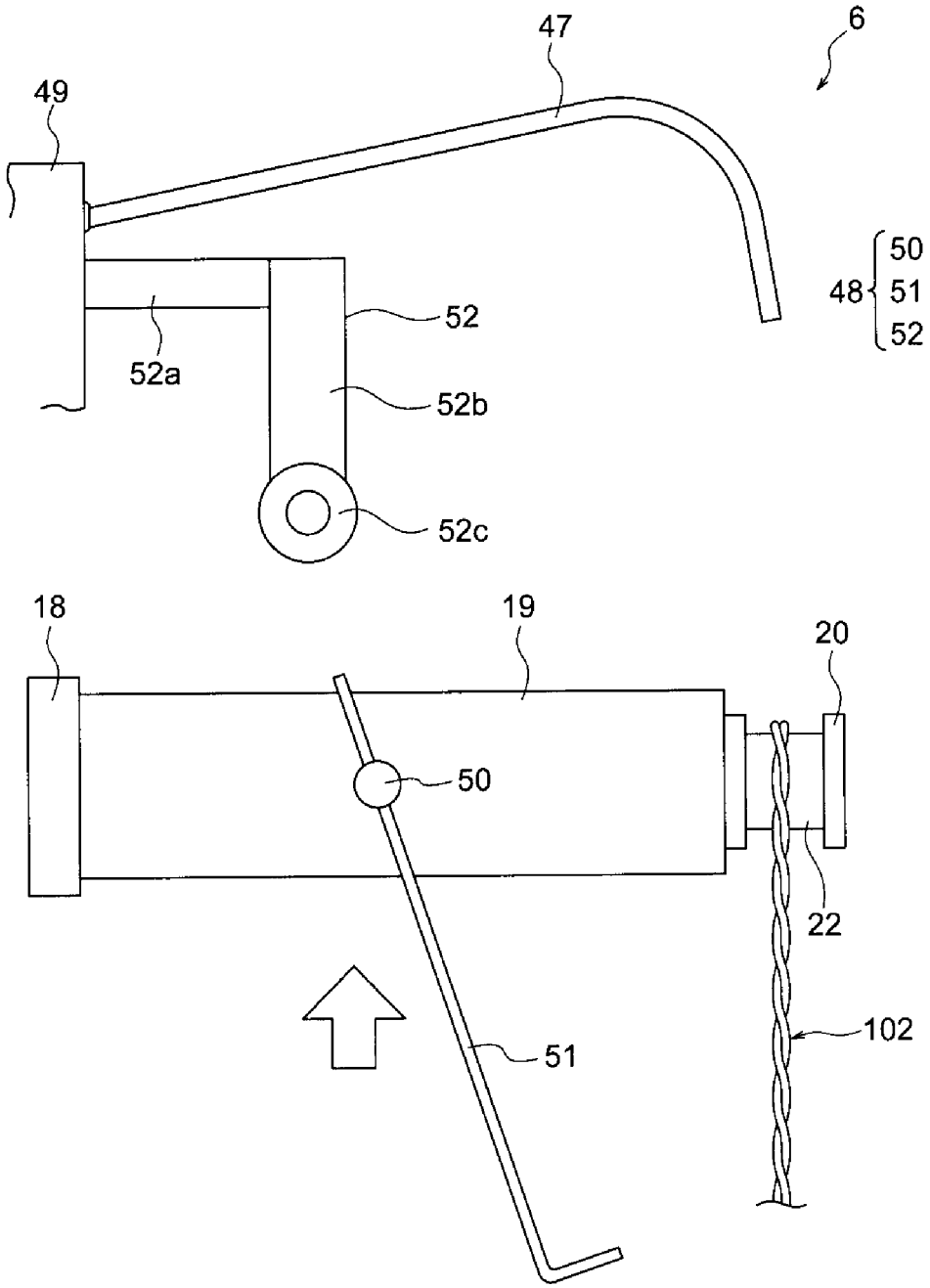
FIG. 24 illustrates a twist wire discharging step that is executed by a twisted wire discharging unit shown in FIG. 1.
Figure 25:
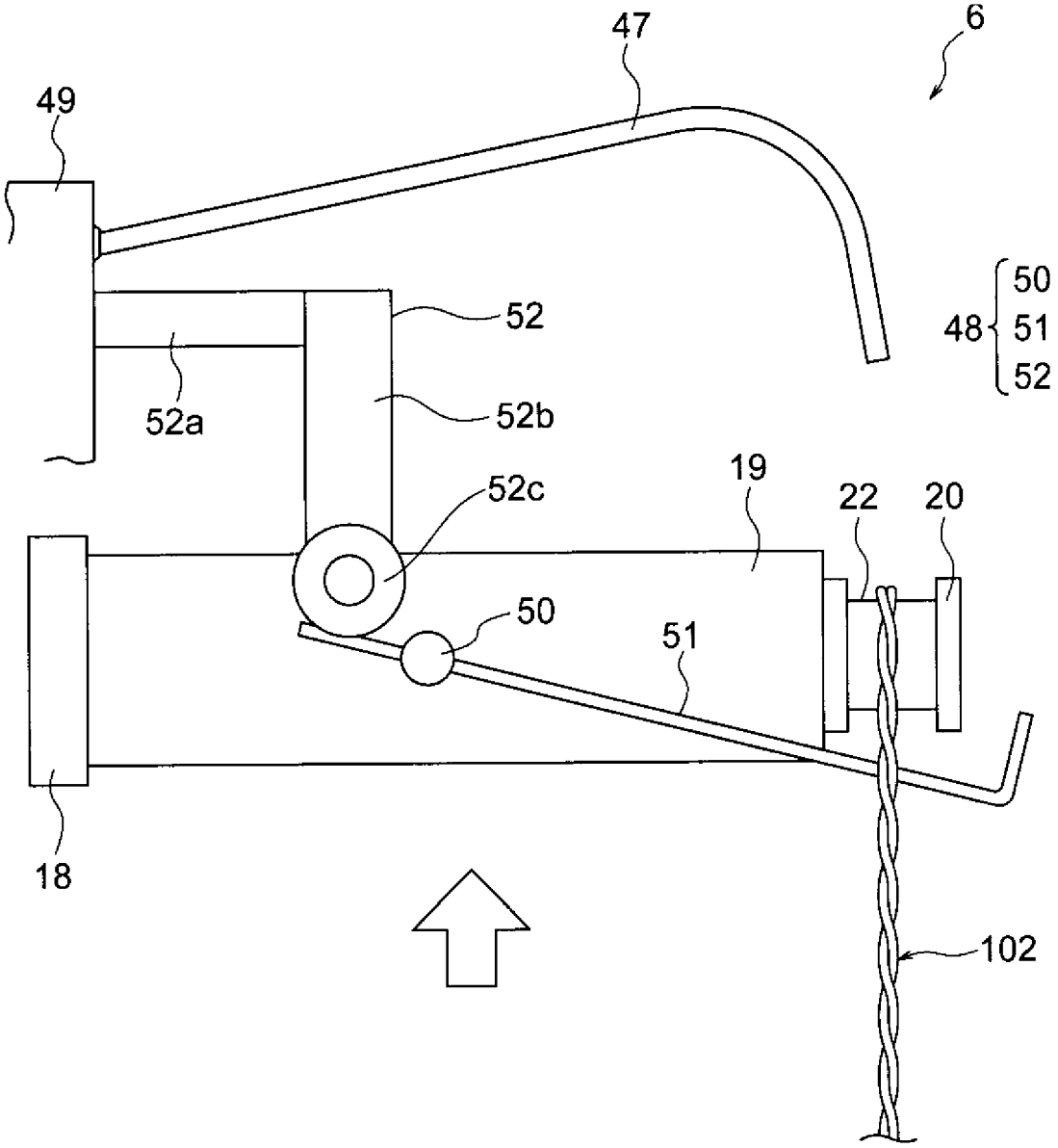
FIG. 25 is another drawing illustrating the twist wire discharging step.
Figure 26:
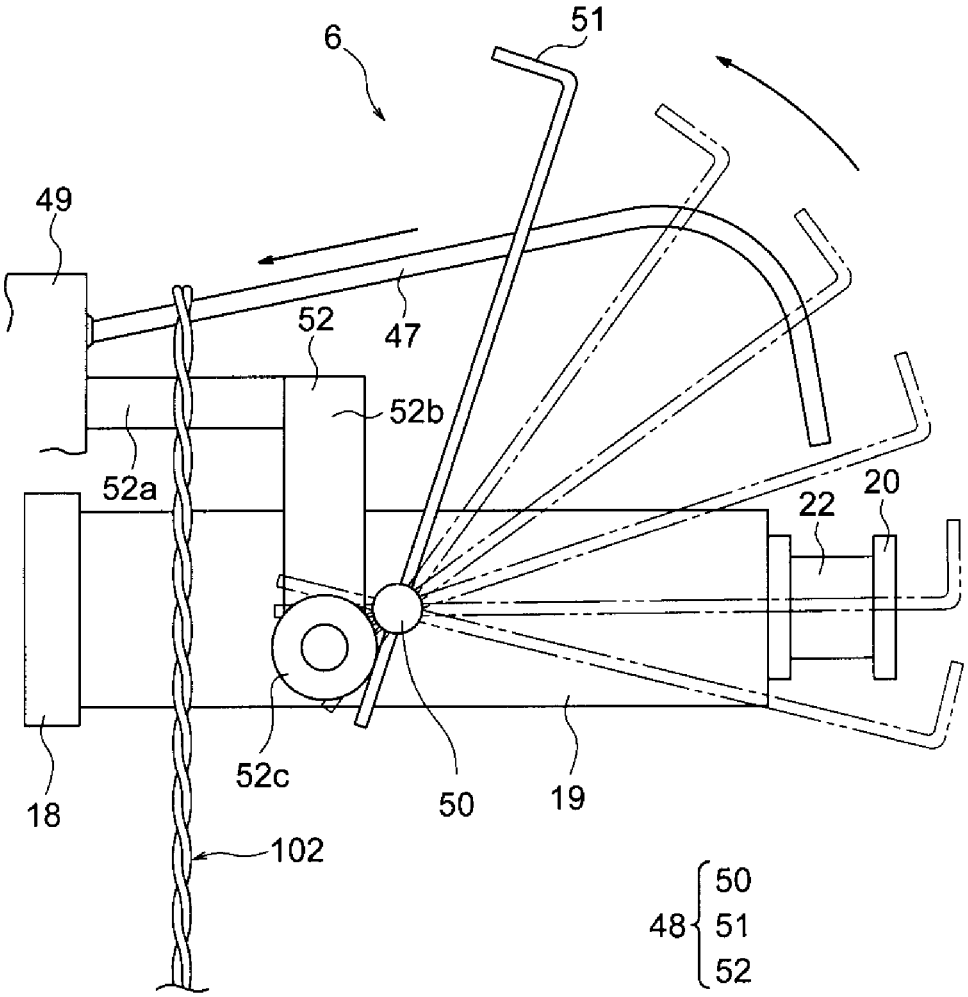
FIG. 26 is a further drawing illustrating the twist wire discharging step.

FIGS. 15-20 illustrate a taping step that is executed using a tape supply unit 5 shown in FIGS. 1 and 2. FIGS. 21A-21C and FIGS. 22A-22C illustrate a wire twisting step that is executed by a wire twisting unit 4. FIG. 23 is a schematic drawing showing a chuck vertical position changing unit that is used in the wire twisting step illustrated by FIGS. 21A-21C and 22A-22C. FIGS. 24-26 illustrate a twisted wire discharging step that is executed by a twisted wire discharging unit 6 shown in FIG. 1.

<Configuration of Twisted Wire Manufacturing Apparatus 1 and Twisted Wire Manufacturing Method>

As shown in FIG. 1, the twisted wire manufacturing apparatus 1, which is an apparatus for manufacturing twisted wires 102 (see FIGS. 4 and 27B), includes the wire pull-out unit 2, the wire pull-up unit 3, the wire twisting unit 4, the tape supply unit 5, the twisted wire discharging unit 6, a control unit (not shown) for controlling the entire apparatus, and a frame 7 which allows installation of the individual units at prescribed positions.

A manufacturing process that is employed in the twisted wire manufacturing apparatus 1 includes a wire pull-out step, a wire middle portion hanging step, a wire end portions chucking step, a wire pull-up step, the wire twisting step, the taping step, and the twisted wire discharging step.

<Twisted Wire 102>

Figure 27A:
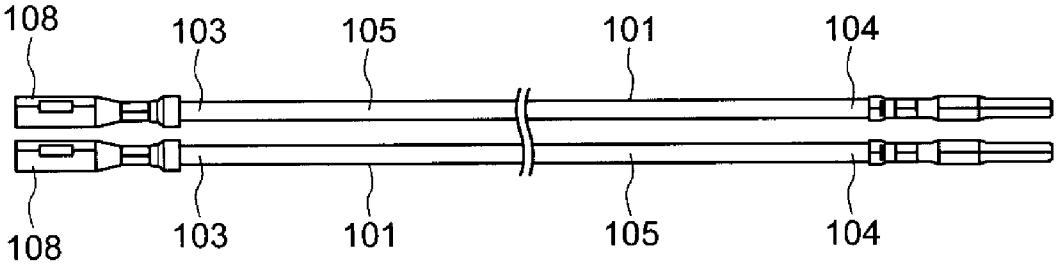
FIGS. 27A and 27B are for description of related manufacturing of a twisted wire.
Figure 27B:
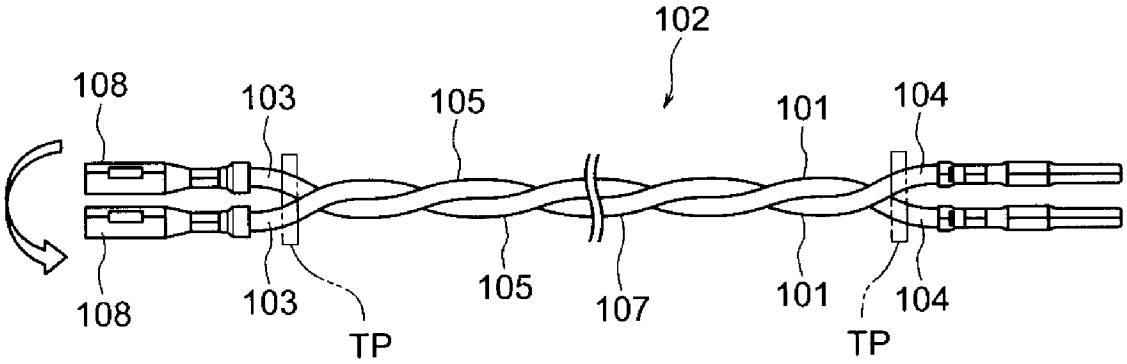

As shown in FIG. 4, each twisted wire 102 has the same structure as the twisted wire 102 shown in FIG. 27B (related manufacturing) and is manufactured by twisting two wires 101 together. Although in the embodiment two wires 101 are twisted together, three or more wires 101 may be twisted together. For example, four wires having the same diameter or different diameters may be twisted together.

<Wire Pull-Out Unit 2>

As shown in FIGS. 1 and 2, the wire pull-out unit 2 is disposed on the deep side in the apparatus when viewed from a worker. The thus-disposed wire pull-out unit 2 is configured so as to be able to pull-out a number of wires 101 to be twisted together to the side of the wire twisting unit 4.

As shown in FIG. 5, the wire pull-out unit 2 employed in the embodiment includes an upper-stage wire pull-out unit 8, a lower-stage wire pull-out unit 9, and a wire housing pipes swinging device 10, and a frame 11. The upper-stage wire pull-out unit 8 is configured so as to be able to pull-out one of two wires 101 to be twisted together. The lower-stage wire pull-out unit 9 is configured so as to be able to pull-out the other of the two wires 101 to be twisted together. The wire housing pipes swinging device 10 is provided to swing lower portions (described later) of the upper-stage wire pull-out unit 8 and the lower-stage wire pull-out unit 9. The frame 11 is provided to allow the upper-stage wire pull-out unit 8, the lower-stage wire pull-out unit 9, and the wire housing pipes swinging device 10 to be installed at prescribed positions. The above units and members will be described below in more detail.

<Upper-Stage Wire Pull-Out Unit 8>

As shown in FIG. 5 and FIGS. 6A-6C, the upper-stage wire pull-out unit 8 is configured so as to be able to house one of two wires 101 to be twisted together in such a manner that a U-turn portion 106 as a middle portion 105 (see FIG. 27A) is exposed on the side of the wire twisting unit 4 (see FIGS. 1 and 2). More specifically, the upper-stage wire pull-out unit 8 includes first-half wire housing units 12 each of which serves to house a portion, from the U-turn portion 106 to one end portion 103, of a wire 101 and second-half wire housing units 13 each of which serves to house a portion, from the U-turn portion 106 to the other end portion 104, of a wire 101.

Each set of a first-half wire housing unit 12 and a second-half wire housing unit 13 has one end portions 12*a* and 13*a* which are located on the side where the U-turn portion 106 is exposed and the other end portions 12*b* and 13*b* which are located on the side opposite to the one end portions 12*a* and 13*a* (i.e., distant from the U-turn portion 106). The other end portions 12*b* and 13*b* are located below the one end portions 12*a* and 13*a*.

The first-half wire housing unit 12 and the second-half wire housing unit 13 have upper wire housing pipes 12*c* and 13*c* (first wire housing pipes) including the respective one end portions 12*a* and 13*a*, lower wire housing pipes 12*d* and 13*d* (second wire housing pipes) including the other respective end portions 12*b* and 13*b*, and intermediate wire housing pipes 12*e* and 13*e* located between the upper wire housing pipes 12*c* and 13*c* and the lower wire housing pipes 12*d* and 13*d*, respectively. Thus, each of the first-half wire housing unit 12 and the second-half wire housing unit 13 is formed in such a manner that a pipe is divided into three parts in its longitudinal direction. The invention is not limited to this case; each of the first-half wire housing unit 12 and the second-half wire housing unit 13 may be formed in such a manner that a gutter-shaped member is divided into three parts in its longitudinal direction. The divisional structure of each of the first-half wire housing unit 12 and the second-half wire housing unit 13 is employed to accommodate various wire lengths.

As shown in FIG. 5, the first-half wire housing unit 12 and the second-half wire housing unit 13 are formed and disposed in such a manner that the upper wire housing pipes 12*c* and 13*c* and the intermediate wire housing pipes 12*e* and 13*e* are inclined from the horizontal direction by a small angle (i.e., they extend obliquely). The lower wire housing pipes 12*d* and 13*d* are formed and disposed so as to extend approximately vertically.

Terminal metal fittings 108 (see FIGS. 27A and 27B) which are attached to the one end portion 103 and the other end portion 104 of the wire 101 are housed inside the respective lower wire housing pipes 12*d* and 13*d*. Although a small number of wires 101 are shown in the drawings (e.g., FIG. 5 and FIGS. 6A-6C) for the sake of convenience (this makes the following problem seem less serious), in actuality several tens of wires 101 and terminal metal fittings 108 are housed in the first-half wire housing units 12 and the second-half wire housing units 13. In this situation, when only one wire 101 is paid out, the pulling-out may be obstructed if the terminal metal fittings 108 that have been housed in the lower wire housing pipes 12*d* and 13*d* are entangled with each other. In the embodiment, a measure is taken to prevent such entanglement. That is, the wire housing pipes swinging device 10 (described later) is provided to prevent such entanglement by swinging the lower wire housing pipes 12*d* and 13*d*.

<Lower-Stage Wire Pull-Out Unit 9>

As shown in FIG. 5 and FIGS. 6A-6C, the lower-stage wire pull-out unit 9 is configured in the same manner as the upper-stage wire pull-out unit 8. More specifically, the lower-stage wire pull-out unit 9 is configured so as to be able to house the other of two wires 101 to be twisted together in such a manner that a U-turn portion 106 as a middle portion 105 (see FIG. 27A) is exposed on the side of the wire twisting unit 4 (see FIGS. 1 and 2). More specifically, the lower-stage wire pull-out unit 9 includes first-half wire housing units 14 each of which serves to house a portion, from the U-turn portion 106 to the one end portion 103, of a wire 101 and second-half wire housing units 15 each of which serves to house a portion, from the U-turn portion 106 to the other end portion 104, of a wire 101.

Each set of a first-half wire housing unit 14 and a second-half wire housing unit 15 has one end portions 14*a* and 15*a* which are located on the side where the U-turn portion 106 is exposed and the other end portions 14*b* and 15*b* which are located on the side opposite to the one end portions 14*a* and 15*a* (i.e., distant from the U-turn portion 106). The other end portions 14*b* and 15*b* are located below the one end portions 14*a* and 15*a*.

The first-half wire housing unit 14 and the second-half wire housing unit 15 have upper wire housing pipes 14*c* and 15*c* (first wire housing pipes) including the respective one end portions 14*a* and 15*a*, lower wire housing pipes 14*d* and 15*d* (second wire housing pipes) including the other respective end portions 14*b* and 15*b*, and intermediate wire housing pipes 14*e* and 15*e* located between the upper wire housing pipes 14*c* and 15*c* and the lower wire housing pipes 14*d* and 15*d*, respectively. Thus, each of the first-half wire housing unit 14 and the second-half wire housing unit 15 is formed in such a manner that a pipe is divided into three parts in its longitudinal direction. The invention is not limited to this case; each of the first-half wire housing unit 14 and the second-half wire housing unit 15 may be formed in such a manner that a gutter-shaped member is divided into three parts in its longitudinal direction. The divisional structure of each of the first-half wire housing unit 14 and the second-half wire housing unit 15 is employed to accommodate various wire lengths.

As shown in FIG. 5, the first-half wire housing unit 14 and the second-half wire housing unit 15 are formed and disposed in such a manner that the upper wire housing pipes 14*c* and 15*c* and the intermediate wire housing pipes 14*e* and 15*e* are inclined from the horizontal direction by a small angle (i.e., they extend obliquely). The lower wire housing pipes 14*d* and 15*d* are formed and disposed so as to extend approximately vertically.

As in the case of the lower wire housing pipes 12*d* and 13*d*, the terminal metal fittings 108 (see FIGS. 27A and 27B) which are attached to the one end portion 103 and the other end portion 104 of the wire 101 are housed inside the respective lower wire housing pipes 14*d* and 15*d*. Although a small number of wires 101 are shown in the drawings (e.g., FIG. 5 and FIGS. 6A-6C) for the sake of convenience (this makes the following problem seem less serious), in actuality several tens of wires 101 and terminal metal fittings 108 are housed in the first-half wire housing units 14 and the second-half wire housing units 15. In this situation, when only one wire 101 is paid out, the pulling-out may be obstructed if the terminal metal fittings 108 that have been housed in the lower wire housing pipes 14*d* and 15*d* are entangled with each other. In the embodiment, a measure is taken to prevent such entanglement. That is, the wire housing pipes swinging device 10 (described later) is provided to prevent such entanglement by swinging the lower wire housing pipes 14*d* and 15*d*.

<Wire Housing Pipes Swinging Device 10>

As shown in FIG. 5, the wire housing pipes swinging device 10 includes, for example, two cylinders 16 and 17 which can expand and contract in the horizontal direction. The wire housing pipes swinging device 10 is configured so as to be able to swing the lower wire housing pipes 12*d*-15*d* at a proper cycle via the cylinders 16 and 17. The wire housing pipes swinging device 10 is provided to prevent entanglement between the terminal metal fittings 108 that have been housed in the lower wire housing pipes 12*d*-15*d* by swinging the lower wire housing pipes 14*d* and 15*d*. (Another device may be employed if it can prevent such entanglement).

<Wire Pull-Out Step>

As shown in FIGS. 1 and 2, in a wire pull-out step, work of holding the U-turn portions of two wires 101 and pulling their first-half portions and second-half portions out of the first-half wire housing units 12 and 14 and the second-half wire housing units 13 and 15 is carried out. Work of the next step is started upon completion of the pulling-out of the wires 101 to the side of the wire twisting unit 4.

<Wire Pull-Up Unit 3>

As shown in FIGS. 1 and 2, the wire pull-up unit 3 is provided to pull up plural pairs of wires 101. The wire pull-up unit 3 includes a unit body 18, wire pull-up mechanisms 19 and wire hanging members 20 which are disposed on the front side of the unit body 18 and a pulling-up drive unit 21 which is disposed on the back side of the unit body 18.

<Wire Pull-Up Mechanism 19>

As shown in FIG. 2 and FIGS. 7A and 7B, each wire pull-up mechanism 19 has a body that is approximately shaped like a rectangular prism and extends forward (i.e., toward the worker side). Rotary shafts 50 (described later) project from left and right side portions of the body of the wire pull-up mechanism 19, respectively. The wire hanging member 20 is attached to a tip portion of the body of the wire pull-up mechanism 19. Each rotary shaft 50 is provided with a transfer hook 51 (described later).

<Wire Hanging Member 20>

As shown in FIGS. 2 and 7, the wire hanging member 20 serves as a member on which the U-turn portions 106 of two wires 101 that have been pulled out in the wire pull-out step are hung. In the embodiment, the wire hanging member 20 is shaped like a circular roller. The entire circumference of the wire hanging member 20 is formed with a recess 22, which serves to make the U-turn portions 106 less prone to come off the wire hanging member 20.

<Pulling-Up Drive Unit 21>

As shown in FIGS. 1 and 2, the pulling-up drive unit 21 includes a motor (not shown), chains 23, etc. The pulling-up drive unit 21 is configured in such a manner that when the motor is activated, the unit body 18 is moved in the vertical direction (i.e., the wire pull-up mechanisms 19 and the wire hanging members 20 are moved in the vertical direction).

<Wire Middle Portion Hanging Step>

As shown in FIGS. 8A and 8B, in a wire middle portion hanging step, work of hanging the U-turn portions of two wires 101 that have been pulled out of the wire pull-out unit 2 on the wire hanging member 20 is carried out. As shown in FIGS. 9A and 9B, the two wires 101 are hung on the wire hanging member 20 in such a manner that the U-turn portions 106 do not cross each other there (i.e., one U-turn portion 106 does not go over the other there). This is because if the U-turn portions 106 cross each other there, the twist pitch is varied.

To prevent the twist pitch from being varied (disordered), the following modification is effective. A modification of the wire pull-up mechanism 19 will be described briefly with reference to FIGS. 10-13.

<Modification of Wire Pull-Up Mechanism 19>

As shown in FIGS. 10-13, a modified wire pull-up mechanism 19A includes a wire pressing member 24 which is disposed above the body of the pull-up mechanism 19A and a wire middle portions separating plate 25 which is disposed below the body of the pull-up mechanism 19A.

<Wire Pressing Member 24>

As shown in FIGS. 10-13, the wire pressing member 24 has a rotary shaft 24*a*, a flat plate 24*b*, and a pressing portion 24*c*. The wire pressing member 24 is provided to press U-turn portions 106 from above after the U-turn portions 106 have been hung on the recess 22 of the wire hanging member 20. The wire pressing member 24 is effective in preventing the wires 101 from coming off or loosening when they are pulled up.

<Wire Middle Portions Separating Plate 25>

As shown in FIGS. 10-13, the wire middle portions separating plate 25 has a rotary shaft 25*a*, a flat plate 25*b*, and a separating portion 25*c*. The wire middle portions separating plate 25 is provided to hang U-turn portions 106 on the recess 22 of the wire hanging member 20 in such a manner that they do not cross each other. The separating portion 25*c* is formed so as to be able to separate the U-turn portions 106 in the front-rear direction. The wire middle portions separating plate 25 provides an advantage that the wires 101 are prevented from crossing each other when the wire middle portions separating plate 25 is used, whereby the twist pitch is kept constant.

It can be said that it is effective to dispose a second wire middle portions separating plate 26 under the wire middle portions separating plate 25. The second wire middle portions separating plate 26 is provided to separate the wires 101 in the left-right direction. The wire pressing member 24 and the wire middle portions separating plate 25 (and the second wire middle portions separating plate 26) are disposed so as to be distant from the wires 101 when they are twisted together (this feature is not illustrated in any drawings).

<Wire Pull-Up Step>

Referring to FIGS. 1-3, the wire pull-up step is a step of pulling up the U-turn portions 106 of each pair of wires 101 in a state that they are hung on the wire hanging member 20 and is divided into a first pull-up step of moving the wire hanging member 20 upward to a proper height before a wire end portions chucking step (described later) and a second pull-up step of moving the wire hanging member 20 upward further after the wire end portions chucking step to apply proper tension to the two wires 101. Dividing the wire pull-up step into the two substeps is just an example. It is assumed that in the states shown in FIGS. 2, 4, and 21A the two wires 101 are given proper tension.

<Wire Twisting Unit 4>

As shown in FIGS. 1-4, the wire twisting unit 4 is provided to perform twisting and chucking on each pair of wires 101. The wire twisting unit 4 is disposed adjacent to the wire pull-up unit 3. The wire twisting unit 4 includes sets of a first-end chucking member 27, a second-end chucking member 28, and same direction rotating members 29.

<First-End Chucking Member 27, Second-End Chucking Member 28, and Same Direction Rotating Members 29>

As shown in FIGS. 2 and 3, the first-end chucking member 27 is configured so as to be able to chuck one end portions of two wires 101. Likewise, the second-end chucking member 28 is configured so as to be able to chuck the other end portions of the two wires 101. The same direction rotating members 29 are configured so as to be able to rotate the first-end chucking member 27 and the second-end chucking member 28 in the same direction.

A step that is executed by the wire twisting unit 4 includes a wire end portions chucking step and a wire twisting step.

<Wire End Portions Chucking Step>

As shown in FIGS. 2 and 3, in the wire end portions chucking step, work of chucking the one end portions 103 and the other end portions 104 of each pair of wires 101 by the first-end chucking member 27 and the second-end chucking member 28, respectively.

Where the number of wires 101 to be twisted together is larger than in the embodiment (two), a wire ends separating plate 30 may be used as shown in FIG. 14. The wire ends separating plate 30 is formed in such a plate-like shape that the arrangement of the wires 101 in the vicinity of the first-end chucking member 27 and the second-end chucking member 28 can be adjusted to a prescribed arrangement through separation. (The wire ends separating plate 30 is removed at the time of twisting of the wires 101). The use of the wire ends separating plate 30 provides advantages that the wires 101 can be twisted together in a state that they are arranged properly and that the twist pitch is prevented from being disordered.

<Wire Twisting Step>

As shown in FIGS. 2-4, in the wire twisting step, the same direction rotating members 29 are activated and the first-end chucking member 27 and the second-end chucking member 28 are thereby rotated in the same direction. The two wires 101 are twisted together until twisted portions 107 are formed in prescribed ranges, which means completion of the twisting.

In the embodiment, untwisting-preventive tape windings TP (described later) are formed at the same time as the twisting.

<Tape Supply Unit 5>

As shown in FIGS. 1-4, the tape supply unit 5, which serves to form tape windings TP, is provided adjacent to the wire twisting unit 4. The tape supply unit 5 includes a tape supply device 32 for supplying untwisting-preventive tapes 31, a tape sticking unit 33 for sticking tapes 31 to each pair of wires 101 at prescribed positions, and a sticking assisting unit 34 for assisting sticking of the remaining portions of the tapes 31 during winding of each pair of wires 101.

<Tape Supply Device 32>

Figure 15:
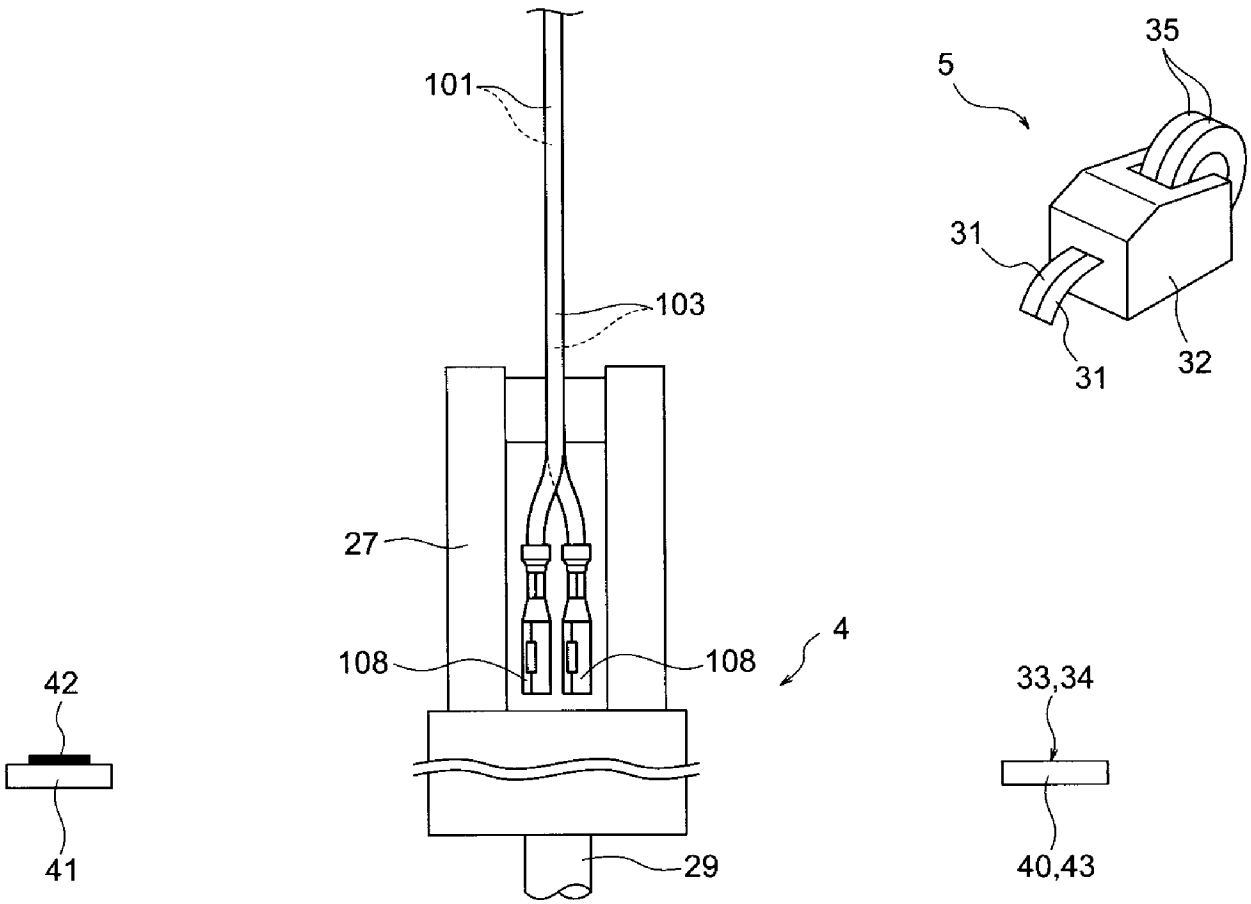
FIG. 15 illustrates a taping step which is executed using a tape supply unit shown in FIGS. 1 and 2.

As shown in FIGS. 2 and 15, the tape supply device 32 is what is called a tape dispenser and is configured so as to be able to supply tapes 31 having a prescribed length from ring-shaped tape main bodies 35 that are arranged side by side.

<Tape Sticking Unit 33>

As shown in FIGS. 2-4, the tape sticking unit 33 is provided using a pair of attachment plates 36 which are attached to the frame 7. The tape sticking unit 33 includes two pairs of rotary shafts 37, a first U-shaped bar 38 which is attached rotatably to one of the two pairs of rotary shafts 37, a second U-shaped bar 39 which is attached rotatably to the other of the two pairs of rotary shafts 37, and a drive unit (not shown) for moving the first U-shaped bar 38 and the second U-shaped bar 39 rotationally (indicated by a chain line in FIG. 16).

The first U-shaped bar 38 and the second U-shaped bar 39 are disposed on the worker side and the side opposite to the worker side, respectively.

The first U-shaped bar 38 is provided with plural sticking blocks 40 at such positions that tapes 31 that the worker has brought from the tape supply device 32 can be set (e.g., sucked or absorbed) and that portions of the tapes 31 can be stuck to (i.e., pressed against) pairs of wires 101 at prescribed positions that are in the vicinities of the one end portions 103 and the other end portions 104 when the first U-shaped bar 38 and the second U-shaped bar 39 are rotated.

On the other hand, the second U-shaped bar 39 is provided with plural pressing blocks 41 at such position that they can prevent the wires 101 from being pushed aside by pushing forces of the sticking blocks 40 when the tapes 31 are stuck, respectively. The pressing blocks 41 are provided with respective cushion members 42.

<Sticking Assisting Unit 34>

As shown in FIGS. 2-4, in the embodiment, the tape sticking unit 33 can also serve as the sticking assisting unit 34. The sticking blocks 40 which are attached to the first U-shaped bar 38 serve as first assisting members 43 of the sticking assisting unit 34. The first assisting members 43 are formed at such positions as to be able to push the tapes 31 attached at the prescribed positions (i.e., cause them to be kept in contact with the wires 101) as the pairs of wires 101 are rotated. In the embodiment, the sticking blocks 41 of the second U-shaped bar 39 are not used as the first assisting members 43 of the sticking assisting unit 34. Where the sticking blocks 41 are used as assisting members 43, the sticking blocks 41 are referred to as second assisting members.

<Taping Step>

A taping step that is executed using the tape supply unit 5 will be will be described below with reference to FIGS. 15-20. As is understood from the above description of the configuration, in this step, tapes 31 are wound on wires 101 at prescribed positions that are in the vicinities of the one end portions 103 and the other end portions 104. The taping step includes a tape supply step, a tape sticking step, and a sticking assisting step; tapes 31 are wound on wires 101 utilizing their rotation as they are twisted together. The winding of the tapes 31 prevents untwisting of each pair of wires 101.

Figure 16:
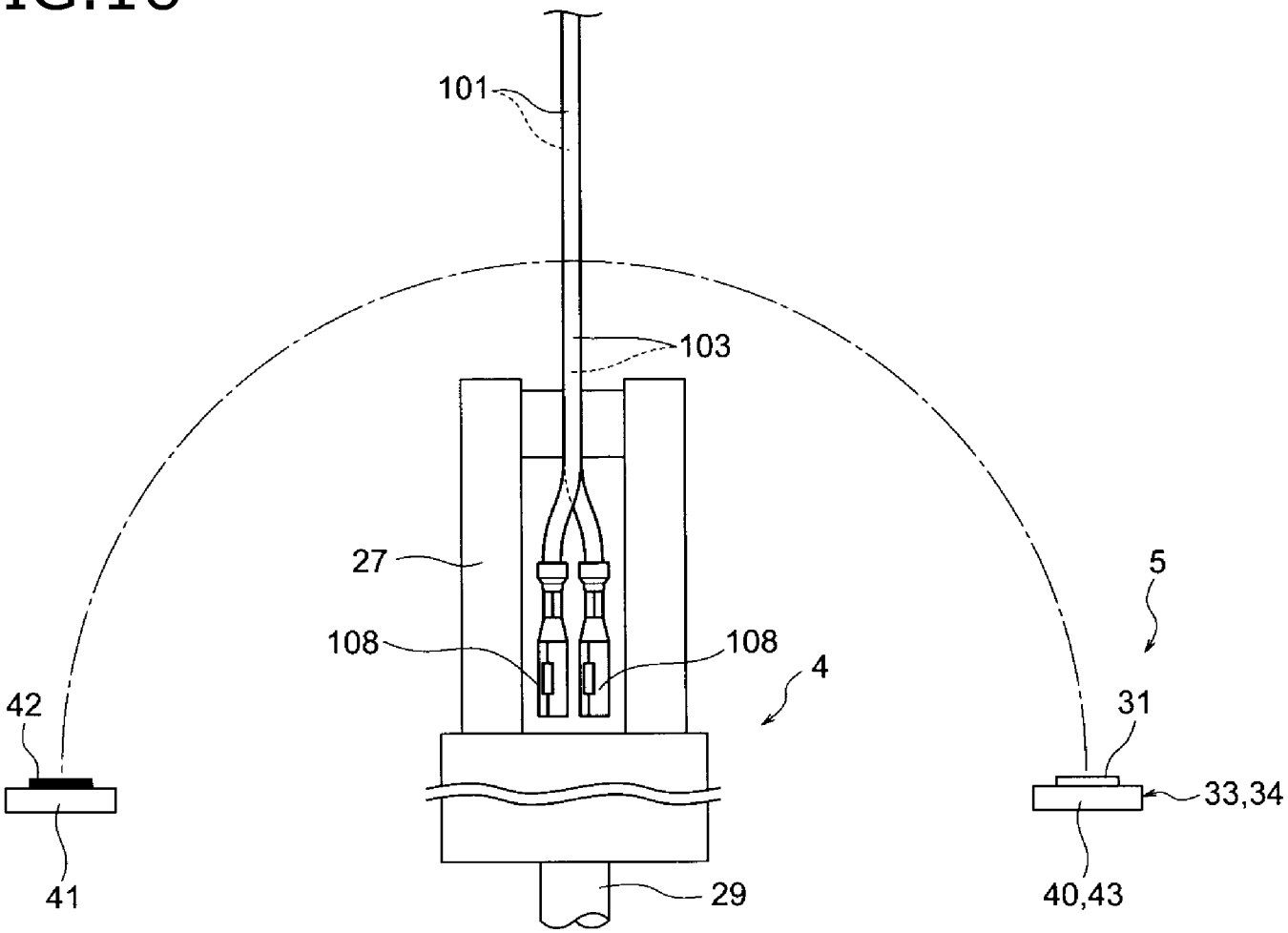
FIG. 16 illustrates a tape winding process that is executed using a tape supply unit.

As shown in FIG. 15, in the tape supply step, tapes 31 having a prescribed length are supplied from the tape supply device 32. As shown in FIG. 16, the worker holds the tapes 31 directly and causes them to, for example, be absorbed on the sticking blocks 40 (each tape 31 is set with its adhesive layer up and its non-adhesive layer is absorbed on the sticking block 40). The tapes 31 are absorbed loosely to such an extent as not to fall down.

Figure 17:
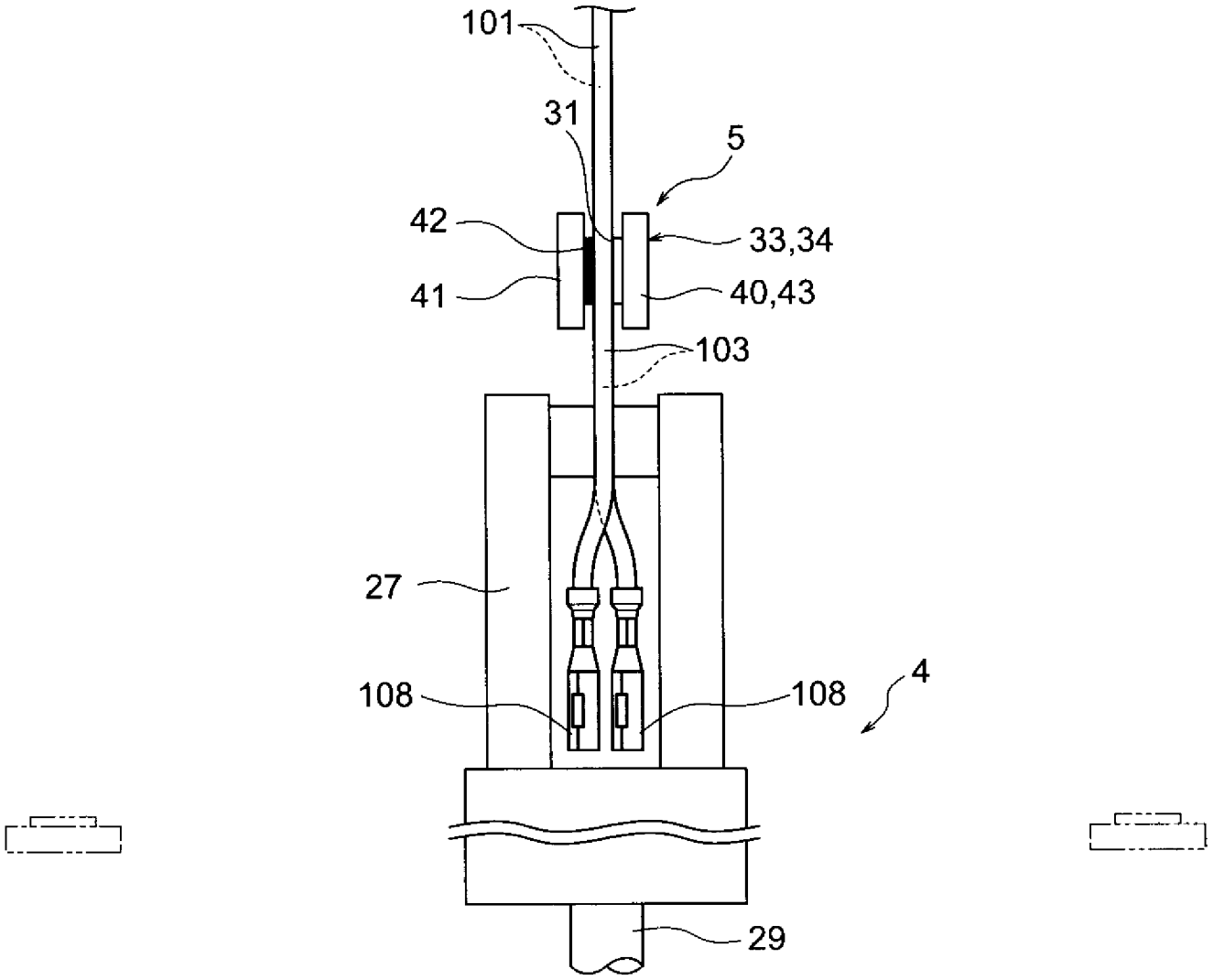
FIG. 17 is another drawing illustrating the tape winding process that is executed using the tape supply unit.
Figure 18:
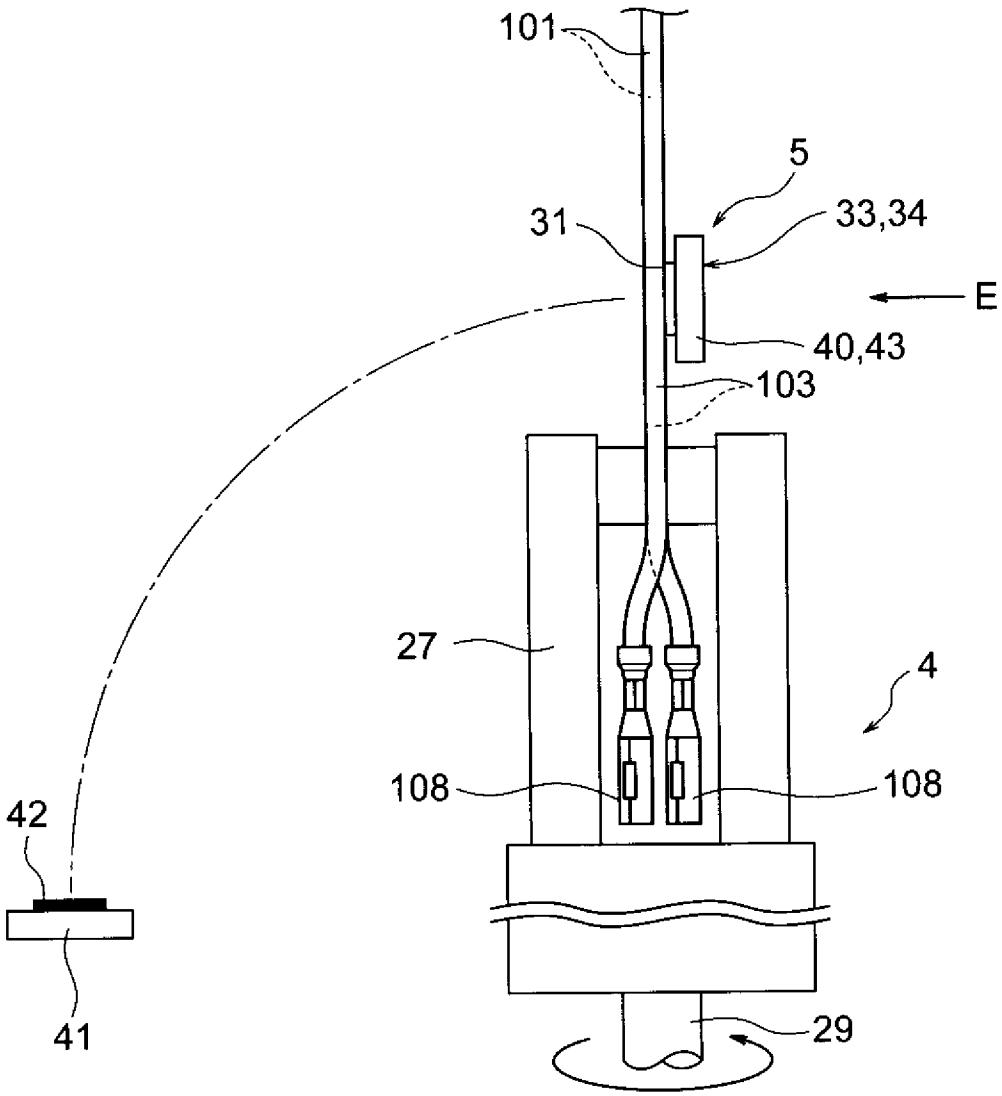
FIG. 18 a still another drawing illustrating the tape winding process that is executed using the tape supply unit.

In the tape sticking step, the sticking blocks 40 and the pressing blocks 41 are moved along an arc-shaped chain line shown in FIG. 16 to positions shown in FIG. 17, whereby prescribed portions of each pair of wires 101 are sandwiched between the corresponding sticking block 40 and pressing block 41. At this time, portions of the tapes 31 are stuck to each pair of wires 101 at the above-mentioned prescribed positions. Then, as shown in FIG. 18, the pressing blocks 41 are returned to their original positions. (It is also possible to move to the next step without returning the pressing blocks 41 to their original positions.

Figure 19:
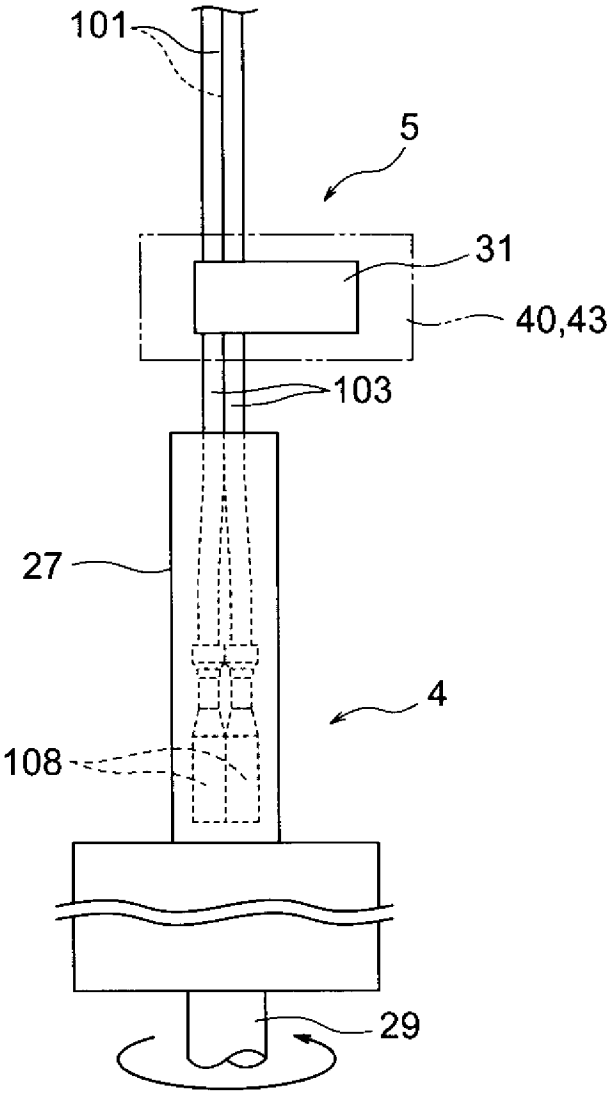
FIG. 19 is a view that is obtained when
Figure 20:
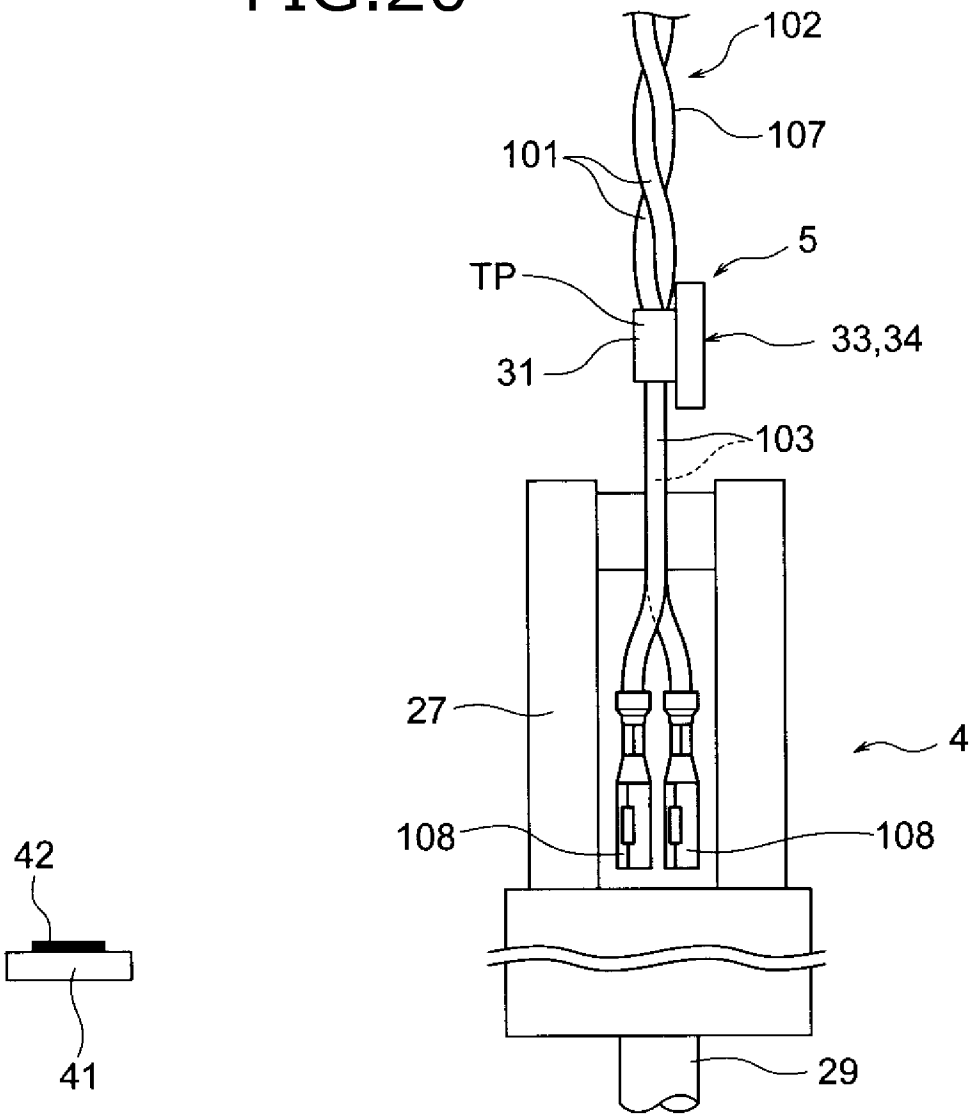
FIG. 20 is a further drawing illustrating the tape winding process that is executed using the tape supply unit.
Figure 21A:
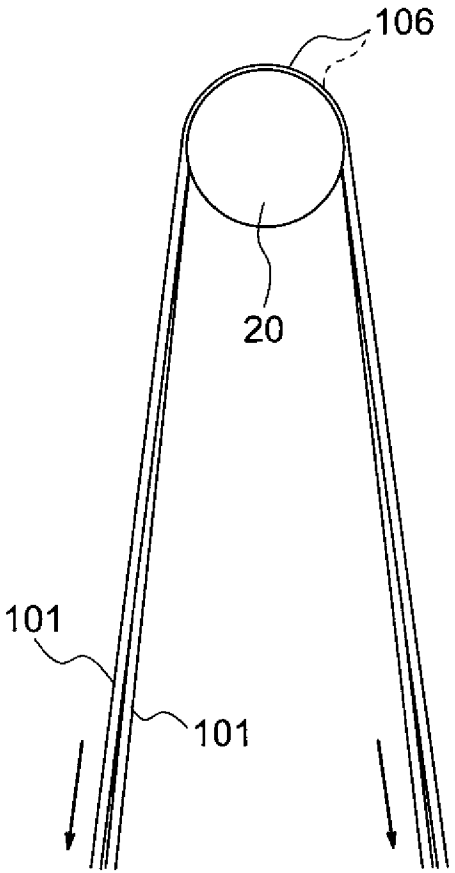
FIGS. 21A-21C illustrate a wire twisting step that is executed by the wire twisting unit shown in FIGS. 1-4.
Figure 21B:
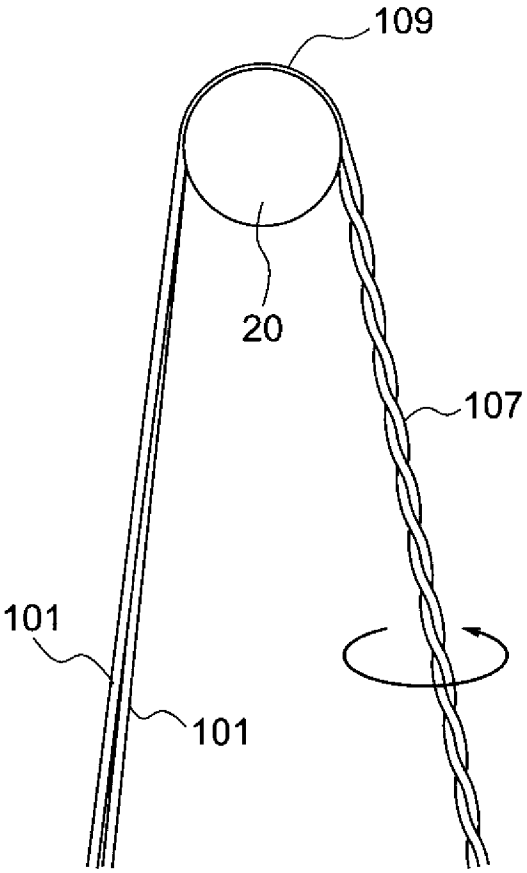
Figure 21C:
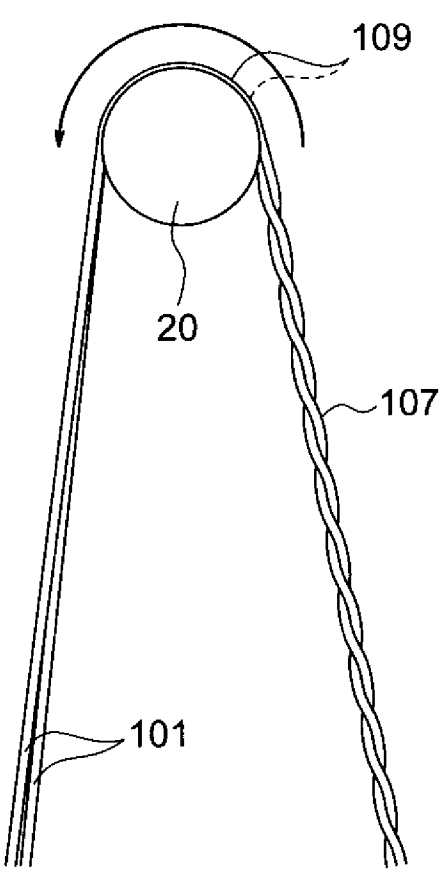
Figure 22A:
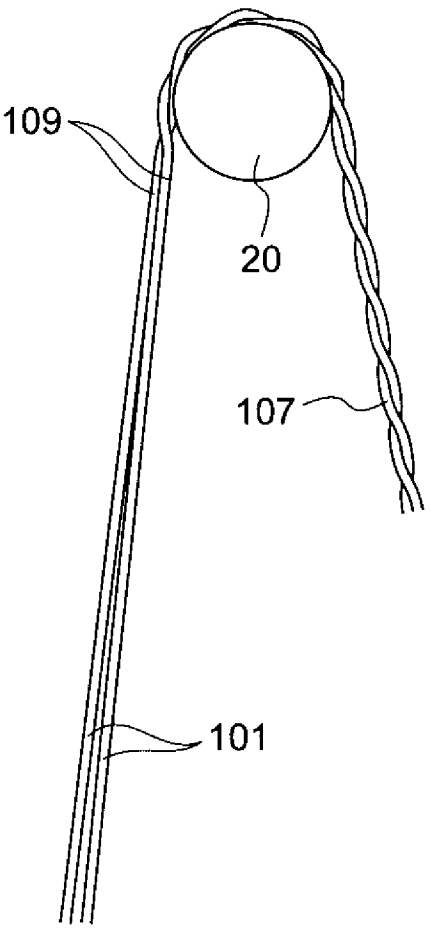
FIGS. 22A-22C are another set of drawings illustrating the wire twisting step that is executed by the wire twisting unit.
Figure 22B:
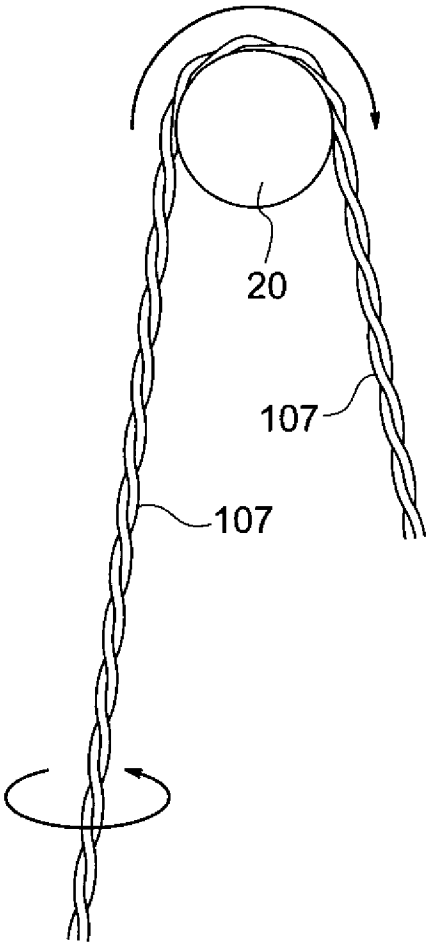
Figure 22C:
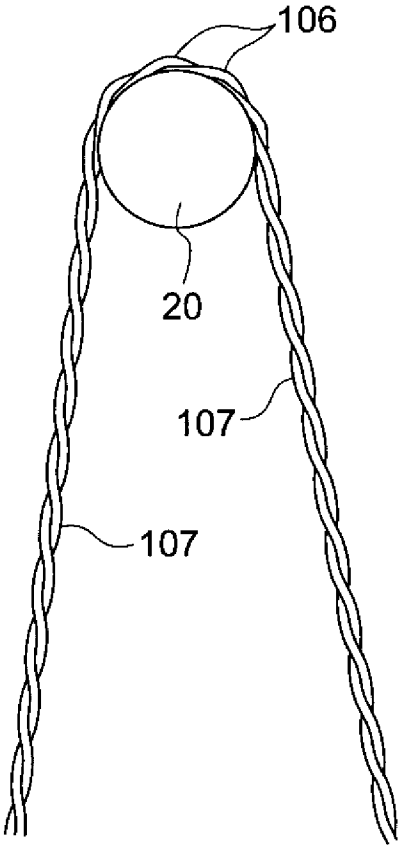

As shown in FIGS. 18 and 19, in the sticking assisting step, each sticking block 40 that is kept adjoining to the prescribed positions of the two wires 101 is used as a first assisting member 43 of the sticking assisting unit 34. The same direction rotating member 29 is activated with this timing, whereby the tape 31 is wound utilizing the twisting of the 101. Since the first assisting member 43 functions so as to push the tape 31 (cause it to be kept in contact with the two wires 101) as the two wires 101 are rotated, the tapes 31 are wound on the two wires 101 surely as shown in FIG. 20. A state that a tape winding TP is thus formed as shown in FIGS. 4 and 20.

With the tape supply unit 5, an untwisting-preventing tape 31 is wound on each pair of wires 101 (i.e., a tape winding TP is formed) utilizing their rotation as they are twisted together. It goes without saying that the above-described tape supply unit 5 can increase the work efficiency.

<Effective Manner of Twisting>

An effective manner of twisting will be described below with reference to FIGS. 21A-21C to FIG. 23. In the wire twisting step, the following first to fourth steps are executed sequentially in this order.

In the first step, one of the first-end chucking member 27 and the second-end chucking member 28 (in the embodiment, the second-end chucking member 28) is rotated in a prescribed direction. As a result, a twisted portion 107 is formed on one side of the wire hanging member 20 (see FIG. 21B). Then, in the second step, the position of the second-end chucking member 28 is moved upward and the position of the first-end chucking member 27 is changed downward. As a result, the U-turn portions 106 that are hung on the wire hanging member 20 are changed from those in the first step. In other words, the position of non-twisted portions 109 is shifted (see FIGS. 21C and 22A).

In the embodiment, as shown in FIG. 23, a chuck vertical position changing unit 44 is employed to change the positions of the first-end chucking member 27 and the second-end chucking member 28 in the vertical direction. The chuck vertical position changing unit 44 is part of the wire twisting unit 4. The chuck vertical position changing unit 44 includes a pair of racks 45 which is moved in the vertical direction according to the circumferential length of the wire hanging member 20 (recess 22), a pinion gear 46 which is in mesh with the pair of racks 45, and a drive mechanism (not shown). Since the position of non-twisted portions 109 is shifted, the non-twisted portions 109 can be twisted together surely in a later step.

Subsequently, in the third step, the first-end chucking member 27 is rotated in a prescribed direction (i.e., in the same direction as the second-end chucking member 28 was rotated). As a result, a twisted portion 107 is formed on the other side of the wire hanging member 20 (see FIG. 22B). Finally, in the fourth step, the positions of the first-end chucking member 27 and the second-end chucking member 28 are returned to their original positions. As a result, the twisted portions 107 which were formed in the first and third steps having the same length, respectively, are disposed on the two respective sides of the wire hanging member 20.

<Twisted Wire Discharging Unit 6>

As shown in FIG. 1, the twisted wire discharging unit 6, which is provided to discharge twisted wires 102 (twist-completed wires 102), is disposed adjacent to the wire pull-up unit 3 in such a manner as to be attached separately to the wire pull-up mechanisms 19 and a top part of the frame 7. The twisted wire discharging unit 6 includes pairs of twisted wire temporary placement hooks 47 and twisted wire transfer mechanisms 48 for transferring twist-completed wires 102 to the respective pairs of twisted wire temporary placement hooks 47.

<Pairs of Twisted Wire Temporary Placement Hooks 47>

As shown in FIGS. 1 and 24, the pairs of twisted wire temporary placement hooks 47 are disposed over the respective wire pull-up mechanisms 19 (above their wire hanging members 20). More specifically, a plate-like hook mounting member 49 is attached to a top part of the frame 7 and the pairs of twisted wire temporary placement hooks 47 project from the front surface of the plate-like hook mounting member 49. Each pair of twisted wire temporary placement hooks 47 are shaped like approximately L-shaped rods having free end portions that are bent downward. A prescribed number of (e.g., one lot of) twist-completed wires 102 can be hung on each pair of twisted wire temporary placement hooks 47 having such a structure.

<Twisted Wire Transfer Mechanisms 48>

As shown in FIGS. 1 and 24, each twisted wire transfer mechanism 48 is configured so as to be able to transfer a twist-completed wire 102 to the corresponding pair of twisted wire temporary placement hooks 47. In the embodiment, each twisted wire transfer mechanism 48 includes a pair of rotary shafts 50, a pair of transfer hooks 51, and a transfer actuation member 52.

<Pair of Rotary Shafts 50 and Pair of Transfer Hooks 51>

As shown in FIGS. 1, 7A and 7B, and 24, the pair of rotary shafts 50 project from left and right side portions of the body of the wire pull-up mechanism 19, respectively. The pair of rotary shafts 50 are cylindrical and rotatable, and are provided with the respective transfer hooks 51. In the embodiment, the pair of transfer hooks 51 are shaped so that a twist-completed wire 102 can be hooked on and picked up by them.

<Transfer Actuation Member 52>

As shown in FIGS. 1 and 24, the transfer actuation member 52 is configured so as to be able to rotate the pair of the pair of transfer hooks 51. More specifically, the transfer actuation member 52 includes a support portion 52*a* which is attached to the hook mounting member 49, a pair of flat plates 52*b* which extend downward from the support portion 52*a*, and a pair of disc-shaped (roller-shaped) hook contact portions 52*c* which are attached to the bottom ends of the pair of flat plates 52*b*, respectively. The pair of hook contact portions 52*c* are disposed at such positions that end portions of the pair of transfer hooks 51 come into contact with them, respectively.

<Twisted Wire Discharging Process>

A twisted wire discharging process that is executed by the twisted wire discharging unit 6 will be described below with reference to FIGS. 24-26.

As shown in FIG. 24, when the body of the wire pull-up mechanism 19 is moved upward by the wire pull-up unit 3 with a twist-completed wire 102 hung on the wire hanging member 20 (the chucking of the end portions of the twist-completed wire 102 is canceled), the rear end portions of the transfer hooks 51 approach the transfer actuation member 52 gradually. After the rear end portions of the transfer hooks 51 come into contact with the transfer actuation member 52, as shown in FIG. 25 the transfer hooks 51 are rotated about the rotary shafts 50. During that course, the twisted wire 102 is picked up by the transfer hooks 51.

As the body of the wire pull-up mechanism 19 continues to be moved upward, as shown in FIG. 26 the twisted wire 102 is discharged to, that is, placed onto the twisted wire temporary placement hooks 47, by the transfer hooks 51. When a prescribed number of twisted wires 102 have been discharged to the twisted wire temporary placement hooks 47, the worker bundles the twisted wires 102 and packs them into a reusable shipping carton, for example. Manufacture of one lot of twisted wires 102 is thus completed.

<Advantages of Twisted Wire Manufacturing Apparatus 1 and Twisted Wire Manufacturing Method>

As described above with reference to FIG. 1 to FIGS. 27A and 27B, since the twisted wire manufacturing apparatus 1 and twisted wire manufacturing method according to the embodiment are configured or executed so as to be able to secure a space necessary for manufacture of twisted wires 102 not only in the horizontal directions (as in related cases) but also in the vertical direction, the total apparatus length can be made much shorter than in related cases.

Since the twisted wire manufacturing apparatus 1 and twisted wire manufacturing method according to the embodiment are configured or executed so as to manufacture each twisted wire 102 with its one end portions 103 and other end portions 104 set close to each other, the end portions of a manufactured twisted wire 102 are also close to each other. Thus, unlike in related cases, a worker need not bother to walk to the position where the far end of a twisted wire is located, which lowers the load of the worker to a large extent.

Since the twisted wire manufacturing apparatus 1 and twisted wire manufacturing method according to the embodiment are configured or executed in such a manner that a manufactured twisted wire 102 is transferred to the twisted wire temporary placement hooks 47 of the twisted wire manufacturing apparatus 1, the efficiency of space utilization is made much higher than in related cases.

Furthermore, since the twisted wire manufacturing apparatus 1 and twisted wire manufacturing method according to the embodiment are configured or executed in such a manner that a worker need not bring manufactured twisted wires 102 to a temporary storage place one by one. This also contributes to lowering the load of the worker to a large extent.

As is understood from the above description, the twisted wire manufacturing apparatus and twisted wire manufacturing method according to the invention can reduce the installation space etc. and increase the work efficiency.

It goes without saying that various changes can be made without departing from the spirit and scope of the invention.

Here, the above embodiments are summarized as follows.

There is provided a twisted wire manufacturing apparatus for manufacturing a twisted wire by twisting at least two wires together, the apparatus comprising:

a wire pull-up unit that pulls up the at least two wires;

a wire twisting unit that is disposed adjacent to the wire pull-up unit, and chucks and twists together the at least two wires; and a twisted wire discharging unit that is disposed adjacent to the wire pull-up unit and discharges a twist-completed wire twisted by the wire twisting unit, wherein the wire pull-up unit includes a wire hanging member that hangs and pulls up U-turn portions of the at least two wires, the U-turn portions being positioned at middle of the at least two wires; and wherein the twisted wire discharging unit includes:

a twisted wire temporary placement hook that is disposed above the wire hanging member; and a twisted wire transfer unit that transfers the twist-completed wire from the wire pull-up unit to the twisted wire temporary placement hook.

For example, as an item (2), the wire hanging member is formed in a circular roller, a recess being formed over a full circumference of the circular roller for hanging the U-turn portions; and the wire pull-up unit further includes a wire pressing member that presses the U-turn portions being hung on the recess of the circular roller.

For example, as an item (3), the wire pull-up unit further includes a separating plate which separates the U-turn portions being hung on the recess of the circular roller into a prescribed wire arrangement.

For example, as an item (4), the wire twisting unit includes: a first chucking member and a second chucking member that chuck one end portions and the other end portions, respectively, of the at least two wires; same direction rotating members that rotate the first chucking member and the second chucking member in the same rotation direction; and a wire ends separating plate that separates portions, in the vicinities of the first chucking member and the second chucking member, of the at least two wires into a prescribed wire arrangement.

The aspect of the invention recited in item (5) provides a twisted wire manufacturing method for manufacturing a twisted wire by twisting at least two wires together, the method including:

a wire middle portion hanging step of hanging U-turn portions of the at least two wires on a wire hanging member, the U-turn portions being positioned at middle of the at least two wires;

a wire end portions chucking step of checking one end portions and the other end portions of the at least two wires;

a wire pull-up step of pulling up the at least two wires in a state that the U-turn portions are hung on the wire hanging member;

a wire twisting step of twisting the at least two wires together after the wire pull-up step is conducted; and a twisted wire discharging step of transferring a twist-completed wire produced by the wire twisting step to a twisted wire temporary placement hook which is disposed above the wire hanging member.

For example, as an item (6), the wire hanging member is formed in a circular roller, a recess being formed over a full circumference of the circular roller for hanging the U-turn portions are hung, and in the wire pull-up step, the U-turn portions being hung on the recess of the circular roller are pressed by a wire pressing member.

For example, as an item (7), in the wire pull-up step, the U-turn portions being hung on the recess of the circular roller are separated into a prescribed wire arrangement by a separating plate.

For example, as an item (8), the twisted wire manufacturing method further includes a same direction rotating step of rotating one end portions and the other end portions of the at least two wires in the same rotation direction.

Since the twisted wire manufacturing apparatus recited in item (1) of the invention is configured so as to be able to secure a space necessary for manufacture of a twisted wire above, an advantage can be provided that the total apparatus length can be made much shorter than in related cases. Since the twisted wire manufacturing apparatus is configured in such a manner that wires are pulled up with their middle, U-turn portions hung on the wire hanging member, a twisted wire is completed in a state that it is U-turned at the top, which provides an advantage that its end portions are set close to each other. Thus, unlike in related cases, a worker need not bother to walk to the position where the far end of a twisted wire is located, which provides an advantage that the load of the worker is lowered to a large extent. Furthermore, since the twisted wire manufacturing apparatus is configured in such a manner that a manufactured twisted wire is transferred to the twisted wire temporary placement hooks of the twisted wire manufacturing apparatus, an advantage is obtained that the efficiency of space utilization is made much higher than in related cases. Still further, since a worker need not bring manufactured twisted wires to a temporary storage place one by one. This also contributes to lowering the load of the worker to a large extent. As such, the twisted wire manufacturing apparatus according to this aspect of the invention provides advantages that the installation space etc. can be reduced and the work efficiency can be increased.

According to the twisted wire manufacturing method recited in item (5) of the invention, a space necessary for manufacture of a twisted wire is secured above, which provides an advantage that the total apparatus length can be made much shorter than in related cases. Since wires are pulled up with their middle, U-turn portions hung on the wire hanging member, a twisted wire is completed in a state that it is U-turned at the top, which provides an advantage that its end portions are set close to each other. Thus, unlike in related cases, a worker need not bother to walk to the position where the far end of a twisted wire is located, which provides an advantage that the load of the worker is lowered to a large extent. Furthermore, since a manufactured twisted wire is transferred to the twisted wire temporary placement hooks, an advantage is obtained that the efficiency of space utilization is made much higher than in related cases. Still further, since a worker need not bring manufactured twisted wires to a temporary storage place one by one. This also contributes to lowering the load of the worker to a large extent. As such, the twisted wire manufacturing method according to this aspect of the invention provides advantages that the installation space etc. can be reduced and the work efficiency can be increased.

The twisted wire manufacturing apparatus recited in item (2) and the twisted wire manufacturing method recited in item (6) provide the following advantages in addition to the advantages of that recited in items (1) and (5). Since the wire hanging member is shaped like a circular roller and is formed with the recess over its full circumference, not only can the middle, U-turn portions of wires be hung on the wire hanging member easily but also the radius of curvature of the U-turn portions thus hung can be made equal to that of the recess. This provides an advantage that no sharply bent portions are formed in the U-turn portions. Furthermore, since the wire pull-up unit further includes the wire pressing member, the U-turn portions being hung on the recess can be pressed down, which provides an advantage that the wires are prevented from coming off or loosening when they are pulled up. Still further, since the wires are prevented from loosening when they are pulled up, a phenomenon does not occur that the wires cross each other (e.g., one wire goes over another wire), which provides an advantage that the twist pitch is prevented from being disordered.

The twisted wire manufacturing apparatus recited in item (3) and the twisted wire manufacturing method recited in item (7) provide the following advantages in addition to the advantages of that recited in items (2) and (6). Since the wire pull-up unit further includes the wire middle portions separating plate, the U-turn portions being hung on the wire hanging member is are separated into a prescribed wire arrangement. This provides advantages that wires can be twisted together with a correct wire arrangement and the twist pitch is prevented from being disordered.

The twisted wire manufacturing apparatus recited in item (4) and the twisted wire manufacturing method recited in item (8) provide the following advantages in addition to the advantages of that recited in items (1) to (3) and items (5) to (7). Since the wire twisting unit includes the first chucking member and the second chucking member and the same direction rotating members, an advantage is obtained that wires in a pulled-up state can be twisted together by rotating the first chucking member and the second chucking member in the same direction by the same direction rotating members. Furthermore, since the wire twisting unit includes the wire ends separating plate, portions, in the vicinities of the first chucking member and the second chucking member, of wires can be separated into a prescribed wire arrangement. This provides advantages that wires can be twisted together with a correct wire arrangement and the twist pitch is prevented from being disordered.

What is claimed is:

1. A twisted wire manufacturing method for manufacturing a twisted wire by twisting at least two wires together, the method comprising:

a wire middle portion hanging step of hanging U-turn portions of the at least two wires on a wire hanging member, the U-turn portions being positioned at a middle portion of the at least two wires;

a wire end portions chucking step of chucking one end portions and the other end portions of the at least two wires;

a wire pull-up step of moving the wire hanging member upward and away from the one end portions and the other end portions to pull up the at least two wires in a state that the U-turn portions are hung on the wire hanging member after the wire end portions chucking step is conducted;

a wire twisting step of twisting the at least two wires together after the wire pull-up step is conducted; and a twisted wire discharging step of transferring a twist-completed wire produced by the wire twisting step to a twisted wire temporary placement hook which is disposed above the wire hanging member.

2. The twisted wire manufacturing method according to claim 1, wherein the wire hanging member is formed in a circular roller, a recess being formed over a full circumference of the circular roller for hanging the U-turn portions are hung; and wherein in the wire pull-up step, the U-turn portions being hung on the recess of the circular roller are pressed by a wire pressing member.

3. A twisted wire manufacturing method for manufacturing a twisted wire by twisting at least two wires together, the method comprising:

a wire middle portion hanging step of hanging U-turn portions of the at least two wires on a wire hanging member, the U-turn portions being positioned at a middle portion of the at least two wires;

a wire end portions chucking step of chucking one end portions and the other end portions of the at least two wires;

a wire pull-up step of pulling up the at least two wires in a state that the U-turn portions are hung on the wire hanging member;

a wire twisting step of twisting the at least two wires together after the wire pull-up step is conducted; and a twisted wire discharging step of transferring a twist-completed wire produced by the wire twisting step to a twisted wire temporary placement hook which is disposed above the wire hanging member, wherein in the wire pull-up step, the U-turn portions being hung on the wire hanging member are separated into a prescribed wire arrangement by a separating plate.

4. The twisted wire manufacturing method according to claim 1, further comprising:

a same direction rotating step of rotating one end portions and the other end portions of the at least two wires in the same rotation direction.

5. The twisted wire manufacturing method according to claim 1, wherein a transfer hook is mounted on a rotary shaft extending perpendicular to the upward direction.

* * * * *